US009206559B2

(12) United States Patent
Bach et al.

(10) Patent No.: US 9,206,559 B2
(45) Date of Patent: Dec. 8, 2015

(54) MAT, PORTABLE POROUS CONSTRUCTION MAT SYSTEM, TOOLS, AND METHODS

(71) Applicant: Reynolds Presto Products Inc., Richmond, VA (US)

(72) Inventors: Gary Michael Bach, Appleton, WI (US); William Gregory Handlos, Manitowoc, WI (US); Bryan Scott Wedin, Green Bay, WI (US)

(73) Assignee: Reynolds Presto Products Inc., Richmond, VA (US)

( * ) Notice: Subject to any disclaimer, the term of this patent is extended or adjusted under 35 U.S.C. 154(b) by 0 days.

(21) Appl. No.: 13/796,144

(22) Filed: Mar. 12, 2013

(65) Prior Publication Data

US 2014/0270945 A1 Sep. 18, 2014

(51) Int. Cl.

| | |
|---|---|
| ***E01C 5/20*** | (2006.01) |
| ***E01C 9/08*** | (2006.01) |
| ***E01C 5/00*** | (2006.01) |

(52) U.S. Cl.

CPC . *E01C 5/005* (2013.01); *E01C 5/20* (2013.01); *E01C 9/086* (2013.01); *E01C 2201/12* (2013.01)

(58) Field of Classification Search

CPC ..... E01C 5/00; E01C 5/18; E01C 5/005; E01C 5/20; E01C 9/086; E01C 9/08; E01C 2201/06; E01C 2201/207; E01C 2201/14; E01C 2201/12; E01C 15/00; E01C 11/225; E04F 2201/09

USPC ..... 404/32, 34, 35, 36, 41; 411/403, 957

See application file for complete search history.

(56) References Cited

U.S. PATENT DOCUMENTS

| | | | | |
|---|---|---|---|---|
| 3,877,339 | A * | 4/1975 | Muenchinger | 411/372 |
| 3,909,996 | A * | 10/1975 | Ettlinger et al. | 52/177 |
| 4,287,693 | A * | 9/1981 | Collette | 52/177 |
| 4,671,699 | A * | 6/1987 | Roach | 404/41 |
| 4,965,097 | A | 10/1990 | Bach | |
| 5,449,543 | A | 9/1995 | Bach et al. | |
| 5,927,906 | A | 7/1999 | Bach et al. | |
| 5,950,378 | A * | 9/1999 | Council et al. | 52/177 |
| 6,395,372 | B1 | 5/2002 | Bach | |
| 7,516,587 | B2 * | 4/2009 | Barlow | 52/591.2 |
| 7,544,010 | B2 | 6/2009 | Restrepo et al. | |
| 7,930,865 | B2 * | 4/2011 | Barlow | 52/741.11 |
| 7,955,025 | B2 | 6/2011 | Murphy et al. | |
| 8,282,310 | B2 | 10/2012 | White | |
| 2003/0190969 | A1 | 10/2003 | Barlow et al. | |
| 2004/0013494 | A1 * | 1/2004 | Lin | 411/403 |
| 2005/0028475 | A1 * | 2/2005 | Barlow et al. | 52/578 |
| 2007/0212196 | A1 * | 9/2007 | Caspi | 411/427 |

(Continued)

OTHER PUBLICATIONS

GEOTERRA™ Structural Mat System Specification & Installation Guideline, pp. 1-17 (Jun. 18, 2008).

MEGADECK™ Field Manual, published prior to Mar. 12, 2013.

MEGADECK™ Heavy-Duty Composite Access Mats, published prior to Mar. 12, 2013.

(Continued)

*Primary Examiner* — Abigail A Risic

(74) *Attorney, Agent, or Firm* — Merchant & Gould P.C.

(57) ABSTRACT

A mat for use in a portable porous construction mat system includes tabs for providing connections to adjacent mats. A portable porous construction mat system includes a plurality of porous units connected together with fastener arrangements. A method of providing a construction mat system includes connecting together porous units with fastener arrangements. A kit includes at least first and second porous units and fastener arrangements.

32 Claims, 23 Drawing Sheets

(56) References Cited

U.S. PATENT DOCUMENTS

| | | | | |
|---|---|---|---|---|
| 2007/0223993 | A1* | 9/2007 | Peterson et al. | 403/364 |
| 2008/0072514 | A1* | 3/2008 | Barlow | 52/540 |
| 2008/0175662 | A1* | 7/2008 | Schmalbach et al. | 404/35 |
| 2012/0047707 | A1 | 3/2012 | Schmalbach et al. | |
| 2012/0243949 | A1 | 9/2012 | Schneider et al. | |

OTHER PUBLICATIONS

Partial International Search Report for PCT/US2014/020334 mailed Jul. 24, 2014.

International Search Report and Written Opinion for PCT/US2014/020334 mailed Oct. 15, 2014.

* cited by examiner

MAT, PORTABLE POROUS CONSTRUCTION MAT SYSTEM, TOOLS, AND METHODS

TECHNICAL FIELD

This disclosure relates to mats for use in portable porous construction systems, the systems utilizing the mats, methods for assembly and use, and tools useful for assembling and disassembling the systems.

BACKGROUND

Industries that work in remote locations such as oil, gas, mining, construction, and others can have site access issues requiring improvements such as the construction of roads or work platforms to provide access to and around the site.

Traditional road and platform construction materials and methods may not be cost effective or environmentally friendly. Alternatives, such as surface mats, are sometimes used. Traditional mat systems, such as mats made from timber or wood, have limitations in that they are expensive, heavy to transport, have a high environmental cost in trees harvested to make the mats, and deteriorate rapidly in use. Polymer and fiber glass mats are large in size and are costly to buy or rent and then transport.

Still other prior art mat systems can be labor intensive to install and assemble, and likewise can be difficult to disassemble if the mat systems become packed with soil.

What is needed is a mat system that can be easily disassembled and removed from the site and which is cost effective, easy to transport, and environmentally friendly.

SUMMARY

In one aspect, a mat for use in a portable porous construction mat system is provided. The mat includes a porous unit having an outer perimeter and a matrix of intersecting walls defining a plurality of cells within the perimeter. The porous unit has a mounting side and a user side. The mat includes a plurality of first and second tabs projecting from a remainder of the porous unit along the perimeter. Each of the first tabs is recessed from the user side and even with the mounting side. Each of the second tabs is recessed from the mounting side and even with the user side. Each of the first and second tabs includes an aperture therein constructed and arranged to allow releasable fastening thereto.

In another aspect, a portable porous construction mat system is provided. The system includes a first porous unit having an outer perimeter and a matrix of intersecting walls defining a plurality of cells within the perimeter and having a mounting side and a user side. A plurality of first and second tabs project from a remainder of the first porous unit along the perimeter. Each of the first tabs is recessed from the user side and even with the mounting side. Each of the second tabs is recessed from the mounting side and even with the user side. Each of the first and second tabs includes an aperture therein constructed and arranged to allow releasable fastening thereto. The system includes a second porous unit laterally adjacent to and against the first porous unit. The second porous unit has an outer perimeter and a matrix of intersecting walls defining a plurality of cells within the perimeter and having a mounting side and a user side. A plurality of first and second tabs project from a remainder of the second porous unit along the perimeter. Each of the second porous unit first tabs is recessed from the user side and even with the mounting side. Each of the second porous unit second tabs is recessed from the mounting side and even with the user side. Each of the second porous unit first and second tabs includes an aperture therein constructed and arranged to allow releasable fastening thereto. One of the second porous unit first tabs is oriented under one of the first porous unit second tabs to define a first connection. One of the second porous unit second tabs is oriented over one of the first porous unit first tabs to define a second connection. The first connection includes a fastener arrangement held within the apertures of the respective first and second tabs of the first connection. The second connection includes a fastener arrangement held within the apertures of the respective first and second tabs of the second connection.

In another aspect, a method of providing a construction mat system is provided. The method includes providing a first porous unit having an outer perimeter and a matrix of intersecting walls defining a plurality of cells within the perimeter and having a mounting side and a user side. A plurality of first and second tabs project from a remainder of the first porous unit along the perimeter. Each of the first tabs is recessed from the user side and even with the mounting side. Each of the second tabs is recessed from the mounting side and even with the user side. Each of the first and second tabs includes an aperture therein constructed and arranged to allow releasable fastening thereto. The method includes providing a second porous unit having an outer perimeter and a matrix of intersecting walls defining a plurality of cells within the perimeter and having a mounting side and a user side. A plurality of first and second tabs project from a remainder of the second porous unit along the perimeter. Each of the second porous unit first tabs is recessed from the user side and even with the mounting side. Each of the second porous unit second tabs is recessed from the mounting side and even with the user side. Each of the second porous unit first and second tabs includes an aperture therein constructed and arranged to allow releasable fastening thereto. The method includes orienting the second porous unit laterally adjacent to and against the first porous unit and so that one of the second porous unit first tabs is oriented under one of the first porous unit second tabs to define a first connection. One of the second porous unit second tabs is oriented over one of the first porous unit first tabs to define a second connection. The method includes putting a fastener arrangement within the apertures of the respective first and second tabs of the first connection. The method includes putting a fastener arrangement within the apertures of the respective first and second tabs of the second connection.

In another aspect, a kit is provided. The kit includes a first porous unit, a second porous unit, and a plurality of fastener arrangements. The first porous unit has an outer perimeter and a matrix of intersecting walls defining a plurality of cells within the perimeter and having a mounting side and a user side. A plurality of first and second tabs project from a remainder of the first porous unit along the perimeter. Each of the first tabs is recessed from the user side and even with the mounting side. Each of the second tabs is recessed from the mounting side and even with the user side. Each of the first and second tabs includes an aperture therein constructed and arranged to allow releasable fastening thereto. The second porous unit has an outer perimeter and a matrix of intersecting walls defining a plurality of cells within the perimeter and having a mounting side and a user side. A plurality of first and second tabs project from a remainder of the second porous unit along the perimeter. Each of the second porous unit first tabs is recessed from the user side and even with the mounting side. Each of the second porous unit second tabs is recessed from the mounting side and even with the user side. Each of the second porous unit first and second tabs includes an aperture therein constructed and arranged to allow releasable fastening thereto. The second porous unit is constructed and arranged to be positioned laterally adjacent to and against the first porous unit and so that one of the second porous unit first tabs can be oriented under one of the first porous unit second tabs to define a first connection. One of the second porous unit second tabs can be oriented over one of the first porous unit first tabs to define a second connection. The plurality of fastener arrangements are sized and shaped to fit within the apertures of the respective first and second tabs of the first connection and within the apertures of the respective first and second tabs of the second connection.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the forgoing general description and the following detailed description are explanatory only, and are not restrictive of the claimed invention.

DETAILED DESCRIPTION

A. Example Mat System

Figure 1:
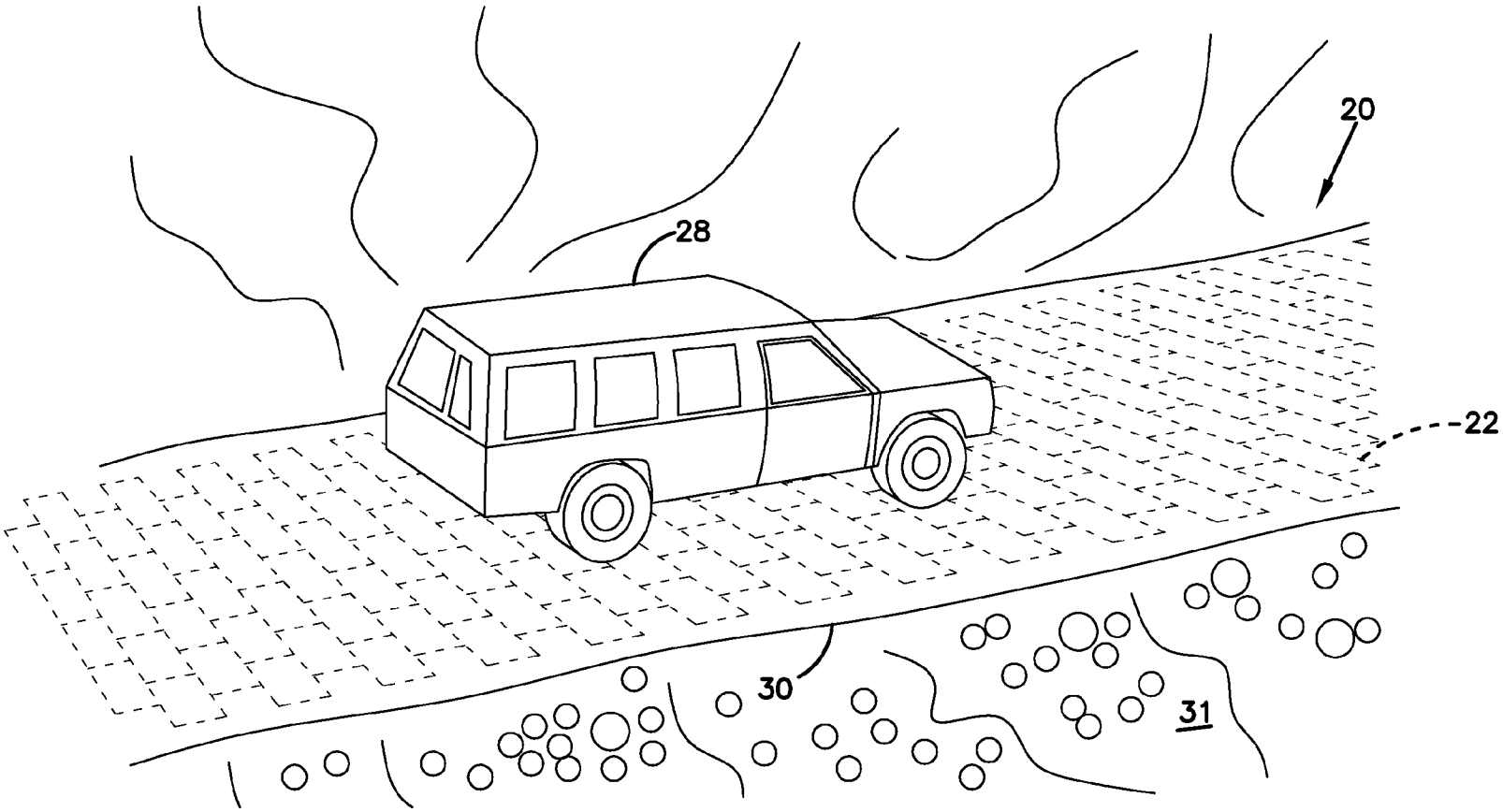
FIG. 1 is a schematic illustration of a portable porous construction mat system installed and in use, constructed in accordance with principles of this disclosure.
Figure 8:
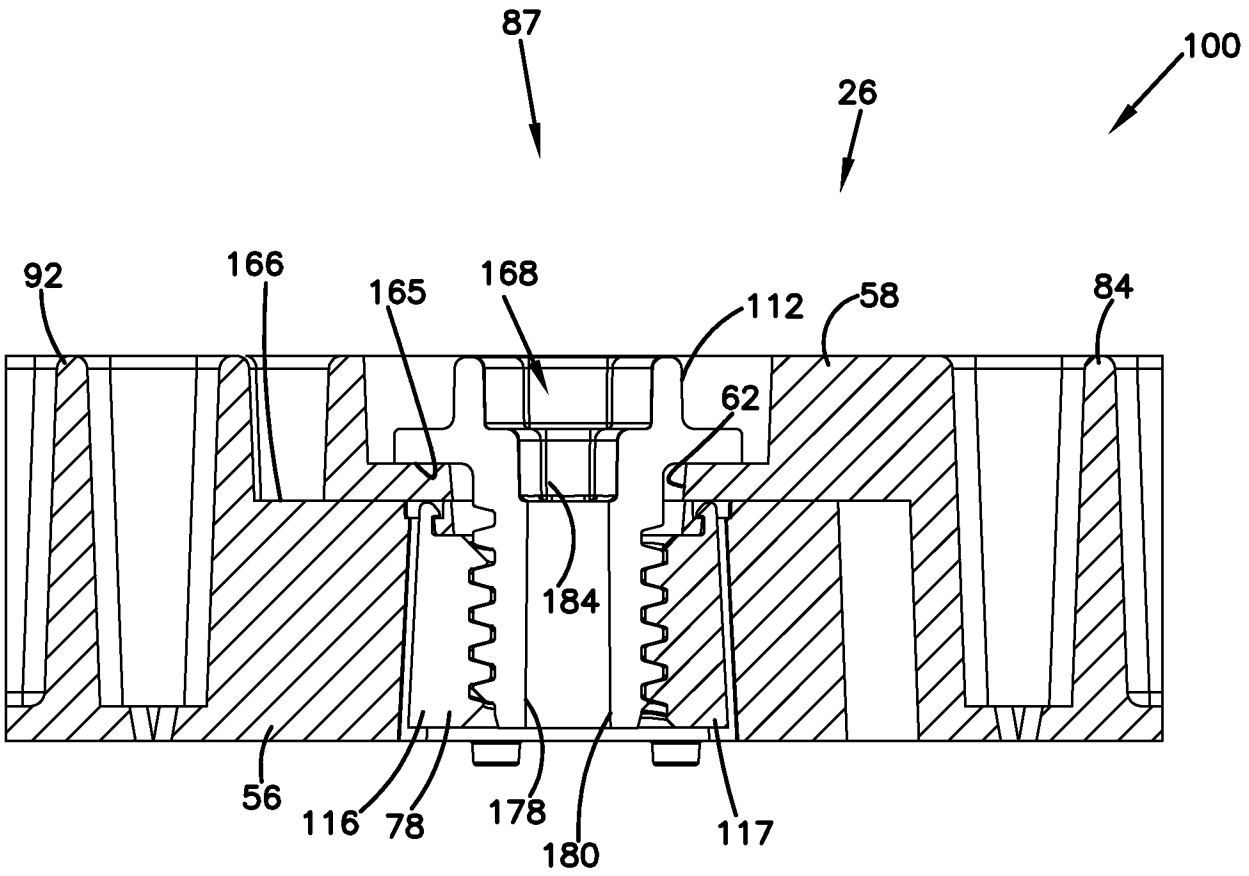
FIG. 8 is a cross-sectional view showing a connection between two of the mats, the cross-section being taken along the line 8-8 of FIG. 7.

FIG. 1 illustrates a portable porous construction mat system generally at 20. The system 20 includes a grid 22, depicted schematically in FIG. 1, made from a plurality of individual construction mats 24 (FIG. 2) secured or connected together at connection points 26 (FIG. 8).

In FIG. 1, a truck 28 is illustrated driving on the grid 22. The grid 22 is oriented on a surface 30, which will typically be earth, including soil or ground 31. In many typical applications, it will be desirable to transport heavy equipment into an area that does not have roads or stable soil. In such applications, a plurality of the construction mats 24 are assembled together to form grid 22 and secured together by the connection points 26. In such systems, the grid 22 is quickly and easily assembled. The grid 22 also is able to be quickly and easily disassembled.

Figure 2:
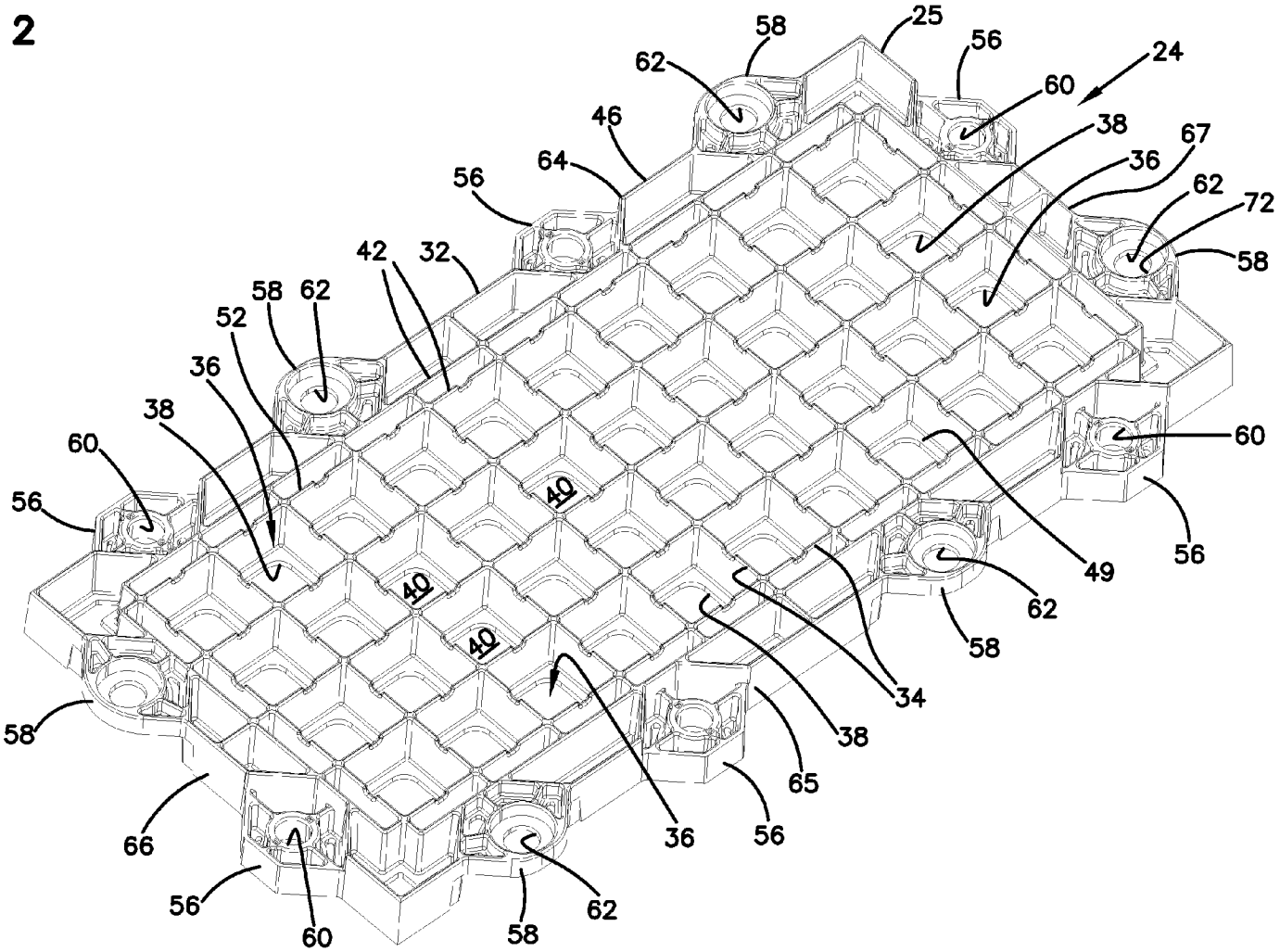
FIG. 2 is a perspective view of one embodiment of a mat for use in a portable porous construction mat system, constructed in accordance with principles of this disclosure, the view showing a user side of the mat.

FIG. 2 shows one example construction mat 24 usable in the system 20. The mat 24 is portable in that it is of a size that can be easily stacked onto pallets and moved. For example, each mat 24 is sized about 40 inches by 20 inches, with a thickness of about 2 inches. There is a nominal coverage area of about 464 in.$^2$. Of course, other sizes are usable.

The mat 24 is a porous unit 25, in that it has ample through holes to allow for drainage throughout the mat 24. The mat 24 has an outer perimeter 32 and a matrix of intersecting walls 34 defining a plurality of cells 36 within the perimeter 32. In the preferred arrangement shown, each of the cells 36 includes a drainage aperture arrangement 38 therein. Typically, this drainage aperture arrangement 38 is in the form of a through hole 40.

The mat 24, in the embodiment illustrated, includes a double wall structure 42 (see FIG. 4) framing the mat 24 and extending between the outer perimeter 32 and the matrix of cells 36. This double wall structure 42 helps with strength and integrity for the mat 24. There is an aperture arrangement 43 (FIG. 4) between the two walls of the double wall structure 42 to assist with drainage.

Figure 3:
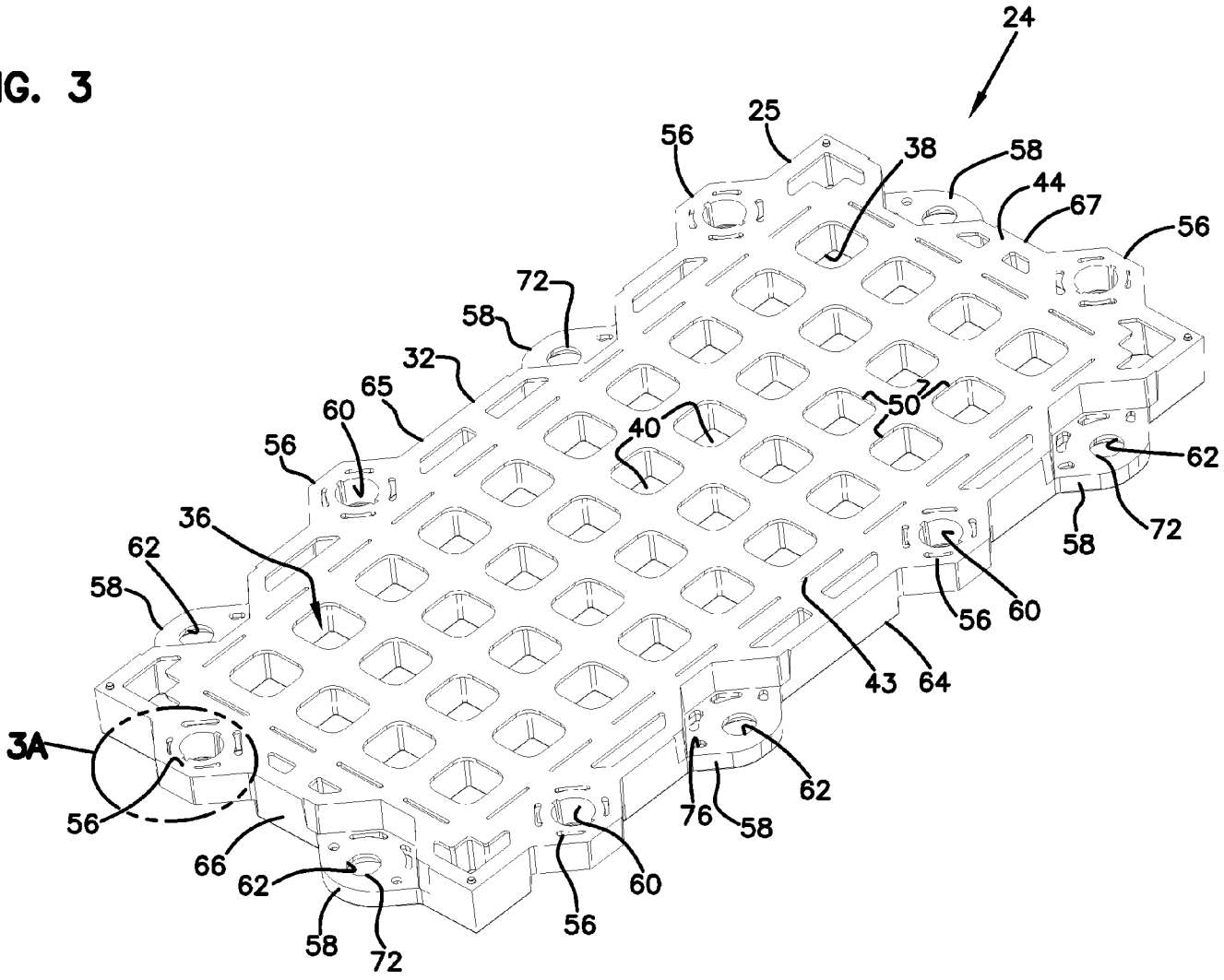
FIG. 3 is another perspective view of the mat of FIG. 2 showing the mounting side of the mat.

Each of the mats 24 has a mounting side 44 and an opposite user side 46. The mounting side 44 is the side that is in contact with the ground surface 30 (FIG. 1). The user side 46 is the side that is open to the surrounding environment and is the side that is exposed to the heavy equipment, such as truck 28 (FIG. 1). In FIG. 2, the user side 46 is the side that is in view. FIG. 3 shows the mounting side 44.

Each of the cells 36 defined by the walls 34 includes the drainage aperture 38, which is depicted as a rectangular hole 40. The holes 40 are defined by an axial surface 48, including a user side axial surface 49 (FIG. 4) and the mounting side axial surface 50 (FIG. 3). Extending approximately perpendicular from the user side axial surface 49 are the walls 34. In the example shown, the walls 34 form approximate rectangles, in which free ends 52 (FIGS. 2 and 5) define and form the user side 46.

Each of the mats 24, in typical example embodiments, will have at least 20 cells 36, typically 30-50 cells 36, and in the example shown, 40 cells 36. Preferably, the mat 24 comprises a molded non-metal material. Usable materials include a molded thermoplastic. Each of the mats 24 has a weight of not greater than 20 lbs., typically 9-15. Each mat 24 will have a crush strength of at least 100 PSI and flexural modulus of 100,000 to 200,000 PSI. The open area of the user side 46 is typically 75-95%. The open area of the mounting side 44 is typically 25-35%.

In accordance with principles of this disclosure, the mat 24 includes a plurality of first and second tabs 56, 58. The first and second tabs 56, 58 each project from a remainder of the porous unit of the mat 24 and along the perimeter 32. The first tab 56 and second tab 58 are useful in connecting more than one mat 24 together to form grid 22.

Each of the first tabs 56 is recessed from the user side 46 and even with the mounting side 50. The first tab 56 includes an aperture 60 constructed and arranged to allow releasable fastening thereto, to be described further below.

Each of the second tabs 58 is recessed from the mounting side 44 and even with the user side 46. Each of the second tabs 58 includes an aperture 62 constructed and arranged allow releasable fastening thereto, to be described further below.

Figure 4:
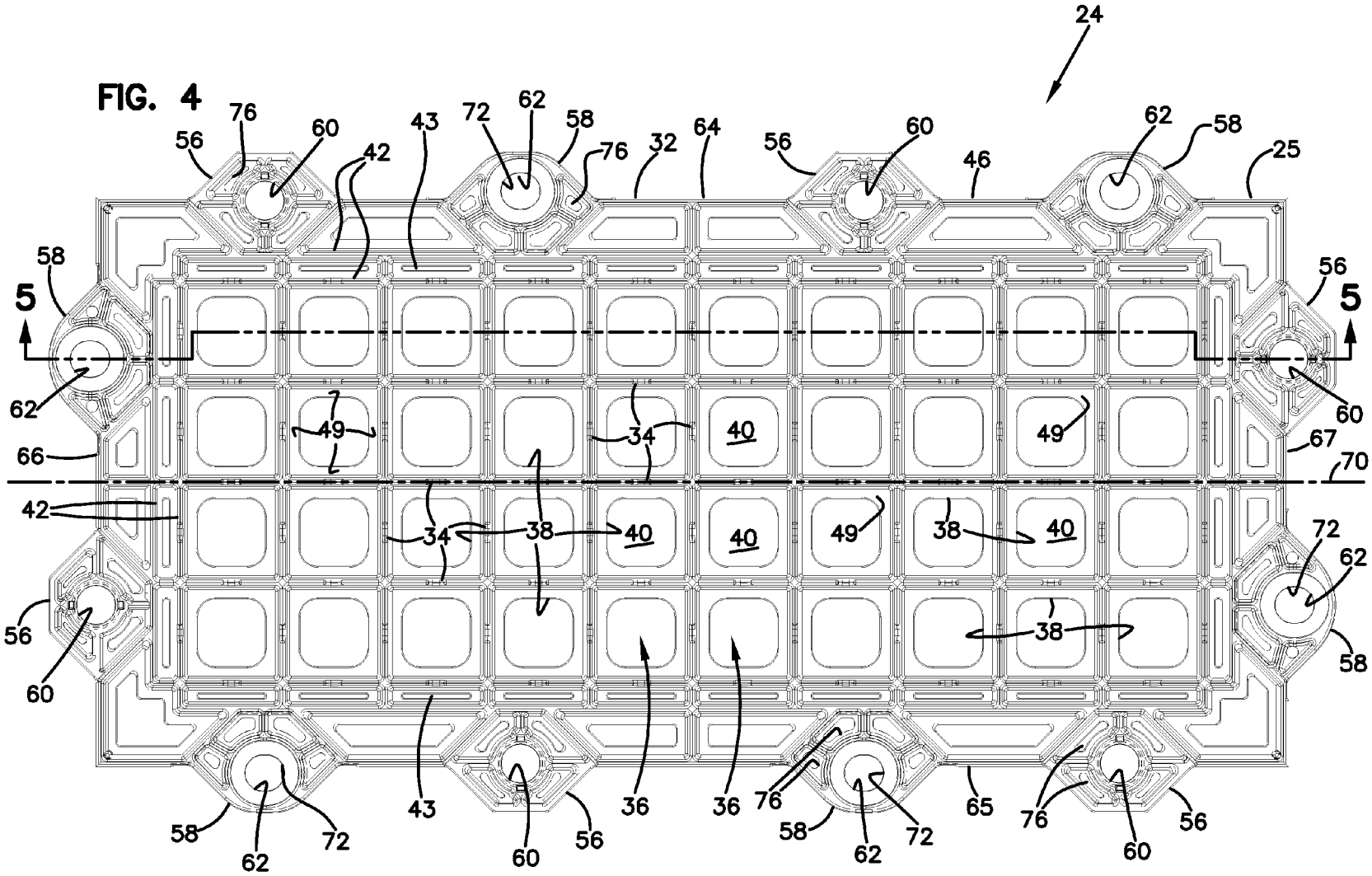
FIG. 4 is a top view of the mat of FIG. 1.
Figure 5:
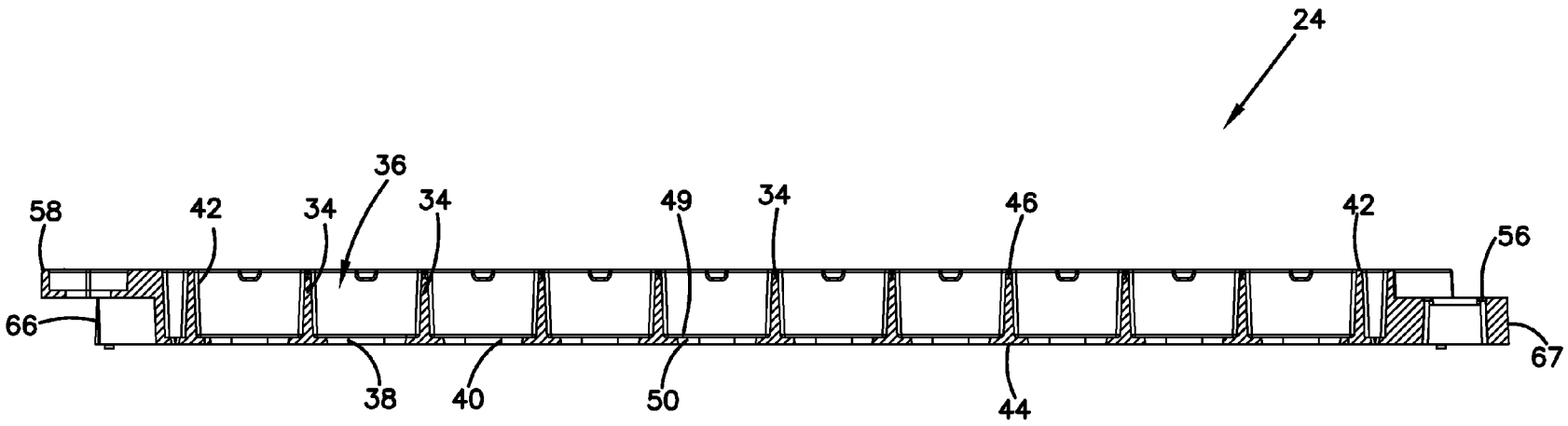
FIG. 5 is a cross-sectional view of the mat of FIGS. 2-4, the cross-section being taken along the line 5-5 of FIG. 4.

From a review of FIGS. 2-4, it can be seen how, in the embodiment illustrated, the mat 24 has a first pair of opposite sides 64, 65 and a second pair of opposite sides 66, 67. Many different embodiments are possible. In the embodiment shown, at least two of the first tabs 56 and at least two of the second tabs 58 are along the perimeter 32 of each of the sides 64, 65 of the first pair of sides. In other embodiments, there can be more than two of the first tabs 56 and more than two of the second tabs 58 along each of the sides 64, 65.

In the illustrated embodiment, at least one of the first tabs 56 and at least one of the second tabs 58 is along the perimeter 32 of each of the sides 66, 67 of the second pair. In other embodiments, there can be more than one of the first tabs 56 and more than one of the second tabs 58 along the sides 66, 67.

Many different embodiments can be made. In the example shown, the first and second tabs 56, 58 alternate sequentially along each of the first pair of sides 64, 65 and along each of the second pair of sides 66, 67.

In this example, the porous unit 25 has a two-fold axis of symmetry about a central longitudinal axis 70 (FIG. 4). Of course, alternate embodiments are possible.

In reference now to FIG. 4, it can be seen how, in the illustrated embodiment, each of the apertures 62 of the second tab 58 is a fastener-receiving aperture 62. In the example shown, the aperture 62 is an elongated non-circular opening 72. This elongated opening 72 builds in tolerance for when the mats 52 are aligned next to each other and connected together to form grid 22. By having the elongated opening 72, the apertures 60, 62 in the first and second tabs 56, 58 need not be in precise alignment to be connected to each other. In other embodiments, the apertures 62 could be circular, or other shapes.

In the particular example embodiment shown in the drawings, each of the apertures 60 of the first tabs 56 is a fastener-receiving aperture 60. The aperture 60, the illustrated embodiment, includes a pair of opposing generally semi-circular surfaces 74, 75 (see FIG. 3A) defining the hole or aperture 60 constructed to receive a fastener. The semi-circular surfaces 74, 75 are separated by a pair of opposite guide slots 152, 153, which are discussed further below. In the example discussed further below, the fastener for the first tab apertures 60 is a nut 78 (FIGS. 8 and 11-14). In other embodiments, the apertures 60 can have threads of nut 78 molded in place. In both embodiments (aperture 60 receiving a separate nut 78, as illustrated; or aperture 60 have pre-molded threads therein acting as a nut), the aperture 60 allows releasable fastening thereto, and is interchangeably referred to herein as "aperture 60" or "fastener-receiving aperture 60."

In each of the tabs 56, 58, adjacent to the fastener-receiving apertures 60, 62, there can be drainage apertures 76 to help further facilitate drainage of the porous unit 25.

Figure 6:
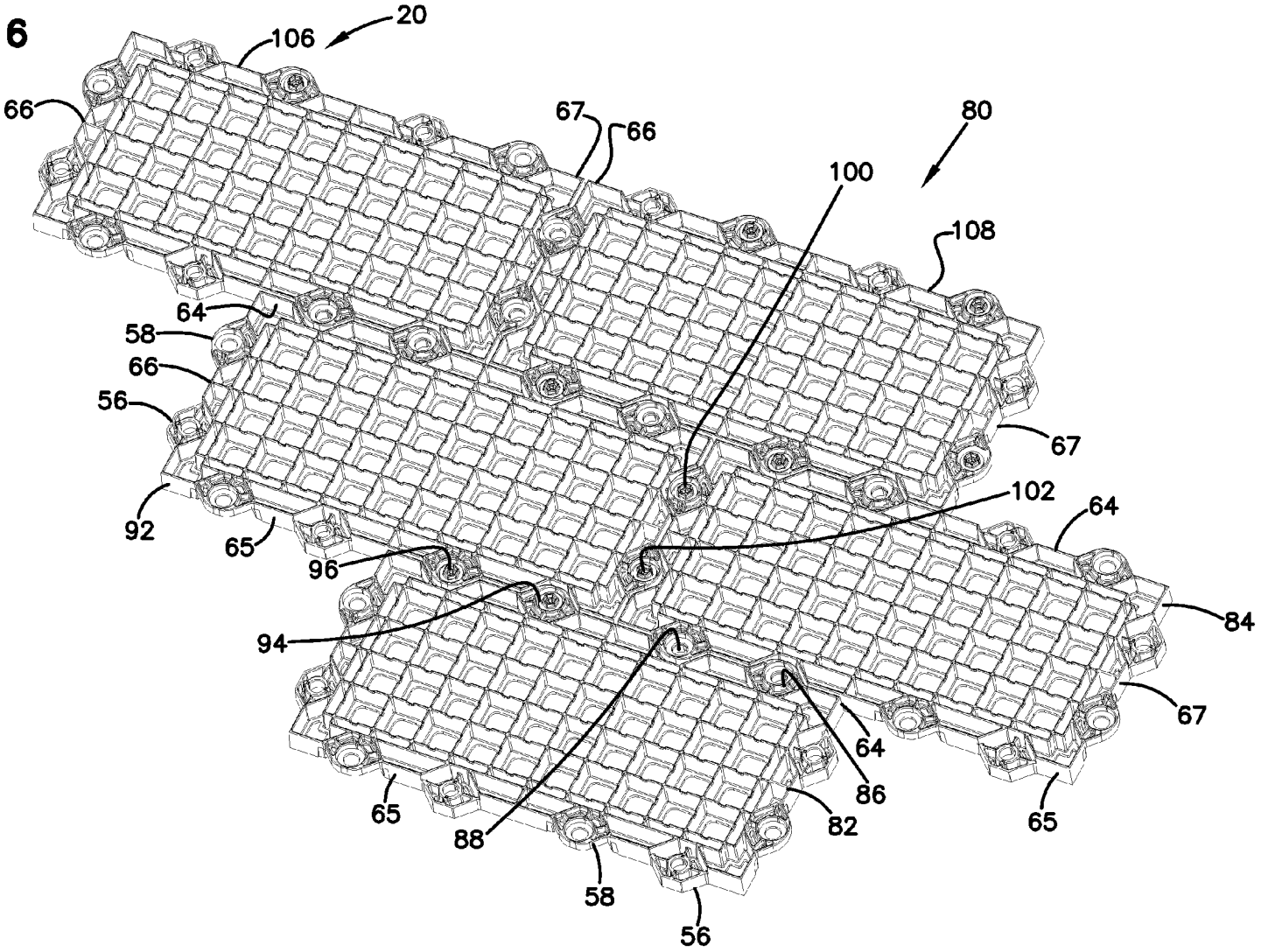
FIG. 6 is a perspective view of a portion of a mat system, utilizing the mat of FIGS. 2-4 connected together.
Figure 7:
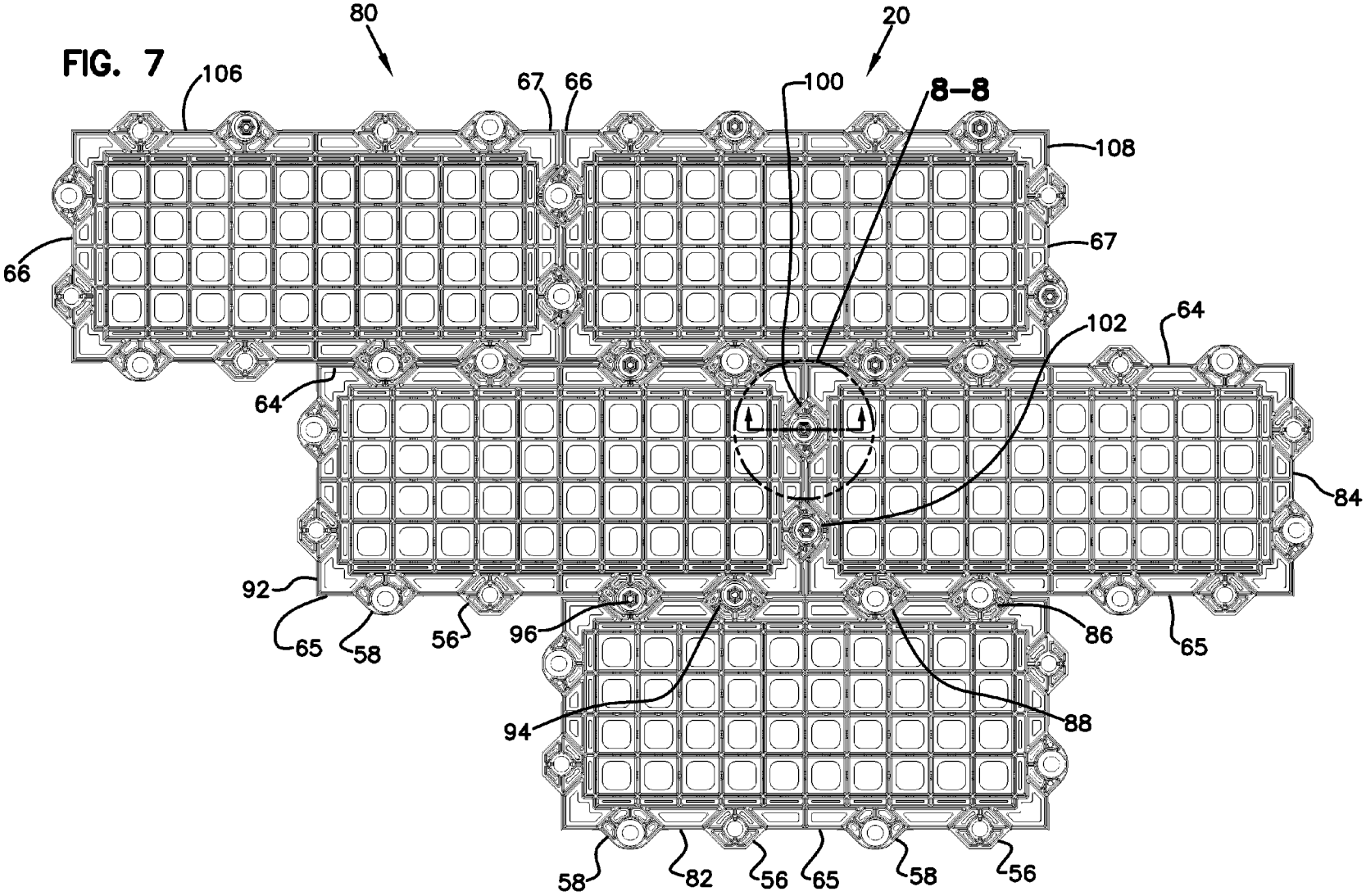
FIG. 7 is a top view of the mat system of FIG. 6.

The mats 24 can be arranged relative to each other and connected together to form the grid 22. In preferred embodiments, the mats 24 are connected together in a staggered pattern in the form of a running bond pattern 80 (FIGS. 6 and 7). By "running bond," it is meant each mat 24 is laid as a stretcher overlapping the mats 24 in the adjoining courses.

To form the mat system 20, and in reference now to FIGS. 6 and 7, a first porous unit is shown at reference number 82, and a second porous unit is shown at reference numeral 84. The second porous unit 84 is oriented laterally adjacent to and against the first porous unit 82. To form the mat system 20, one of the first tabs 56 of the second porous unit 84 is oriented under one of the second tabs 58 of the first porous unit 82 to define a first connection 86. One of the second tabs 58 of the second porous unit 84 is oriented over one of the first tabs 56 of the first porous unit 82 to define a second connection 88.

The first connection 86 will include a fastener arrangement 87 (FIG. 8) to be held within the fastener-receiving apertures 60, 62 of the first and second tabs 56, 58 of the first connection 86. The second connection 88 will include fastener arrangement 87 (FIG. 8) to be held within the fastener-receiving apertures 60, 62 of the respective first and second tabs 56, 58 of the second connection 88. In FIGS. 6 and 7, the first and second connections 86, 88 show only a portion of the fastener arrangement 87 (nut 78) therein, ready to receive the other portion of the fastener arrangement (bolt 112).

Still in reference to FIGS. 6 and 7, the mat system 20 further includes at least a third porous unit 92 laterally adjacent to and against the first porous unit 82. One of the first tabs 56 of the third porous unit 92 is oriented under one of the second tabs 58 of the first porous unit 82 to define a third connection 94 attached by a fastener arrangement 87. One of the second tabs 58 of the third porous unit 92 is oriented over one of the first tabs 56 of the first porous unit 82 to define a fourth connection 96 attached by fastener arrangement 87.

In the example shown in FIGS. 6 and 7, the first connection 86, second connection 88, third connection 94, and fourth connection 96 are all along a single side 64 (FIG. 6) of the first porous unit 82.

Again, still in reference to FIGS. 6 and 7, the second porous unit 84 and the third porous unit 92 are connected together at a fifth connection 100 and sixth connection 102 along sides 66, 67 of the second porous unit 84 and third porous unit 92 that are generally perpendicular to the single side 64 of the first porous unit 82. The fifth connection 100 includes one of the first tabs 56 of the third porous unit 92 being oriented under one of the second tabs 58 of the second porous unit 84 and attached by fastener arrangement 87. The sixth connection 102 includes one of the second tabs 58 of the third porous unit 92 being oriented over one of the first tabs 56 of the second porous unit 84 and attached by fastener arrangement 87.

In the embodiment illustrated in FIGS. 6 and 7, the system 20 also includes at least a fourth porous unit 106 and a fifth porous unit 108. In the example embodiment shown, the fourth porous unit 106 is connected to the third porous unit 92 along side 64 of the third porous unit 92, opposite of side 65 that is connected to the first porous unit 82. The fifth porous unit 108 is shown connected to both the third porous unit 92 and the second porous unit 84. The fifth porous unit 108 is connected to side 64 of units 92 and 84, opposite of the sides 65 of third unit 92 and second unit 84 that are connected to the first porous unit 82. The fourth porous unit 106 and fifth porous unit 108 are also connected to each other along sides 67 of the fourth porous unit 106 and 66 of the fifth porous unit 108.

In mat systems 20, the pattern shown in FIGS. 6 and 7, forming the running bond pattern 80, would be continued until the desirable size of the system 20 is reached.

The first and second tabs 56, 58 of each of the first porous unit 82, second porous unit 84, third porous unit 92, fourth porous unit 106, and fifth porous unit 108, alternate sequentially with each other. That is, in the example embodiment illustrated, each of the porous units 82, 84, 92, 106, 108 has first tabs 56 alternating sequentially with second tabs 58. There are no first tabs 56 together, without being separated by a second tab 58; similarly, there are no second tabs 58 together without being separated by a first tab 56.

B. Example Fastener Arrangements and Related Components

As mentioned above, the first connection 96, second connection 88, third connection 94, fourth connection 96, fifth connection 100, and sixth connection 102 include fastener arrangement 87 (FIG. 8) connecting together the respective first and second tabs 56, 58 of each connection 86, 88, 94, 100, 102. Many different embodiments are possible. In the illustrated embodiment, the fastener arrangement 87 includes nut 78 and bolt 112. FIG. 8 illustrates the connection 100, but it should be understood that each connection 86, 88, 94, and 102 will be constructed analogously.

In the example embodiment, the nut 78 is a split nut 114 (FIGS. 11-14). The split nut 114 can be made from a molded non-metal material. In some embodiments, the molded non-metal material is made from the same material as the porous units 25, such as a molded thermoplastic. In other embodiments, the split nut 114 is made of a stronger material than the porous units 25, such as nylon with glass reinforcement. This stronger material can be helpful if a stronger connection is needed between the tabs 56, 58. By making the nut 78 a split nut 114, the molding techniques are simpler and more cost effective than if the nut 78 were not a split nut 114.

As can be seen in FIGS. 11-14, the split nut 114 includes first and second halves 116, 117. The halves 116, 117 are fitable together to form integral nut 78 having a generally tapered and circular outer cross-section.

Figure 13:
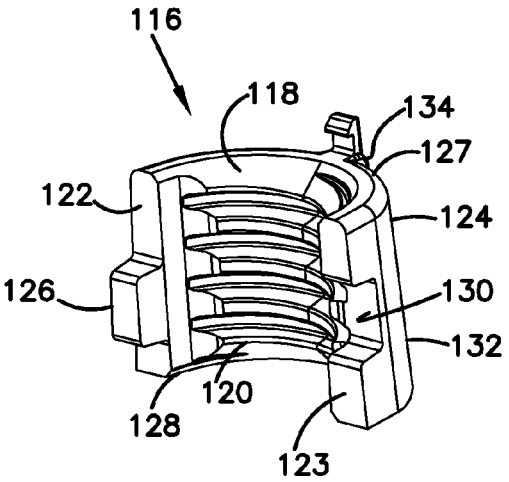
FIG. 13 is a perspective view of a first half of the split nut of FIG. 11.

In reference to FIG. 13, half nut 116 includes an inner surface 118 with threads 120. Half nut 117 includes an inner surface 119 with threads 121. The threads 120, 121 are for engaging the bolt 112.

The first half 116 of the split nut 114 has a first side 122, second side 123, and an arched extension 124 therebetween. The first side 122 includes a projection 126 extending therefrom. The projection 126 is spaced from both a top rim 127 and bottom rim 128. The second side 123 includes a recess 130, spaced from both the top rim 127 and bottom rim 128.

The arched extension 124 includes inner surface 118, as mentioned previously, which is threaded 120. An exterior surface 132 of the arched extension 124 includes a projecting rail 134. The rail 134, in the embodiment shown, is centered between the first side 122 and second side 123.

The second half 117 of the split nut 114 is constructed to mate with the first half 116 and result in nut 78 that has a threaded socket 136 (FIG. 11) to engage the bolt 112.

Figure 14:
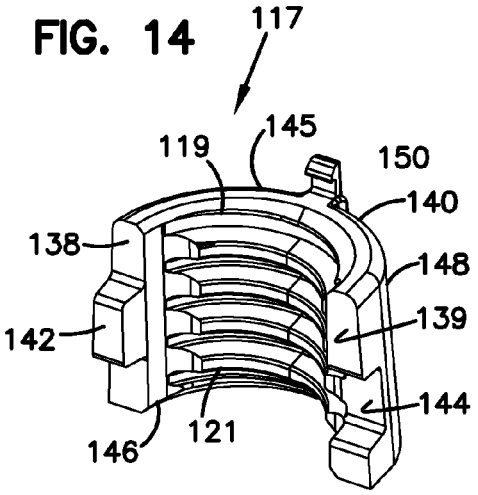
FIG. 14 is a perspective view of a second half of the split nut of FIG. 11.

Referring now to FIG. 14, the second half 117 includes first side 138, second side 139, and arched extension 140 extending therebetween. The first side 138 includes a projection 142, and the second side 139 includes a recess 144. The projection 142 and recess 144 are spaced from the top rim 145 and bottom rim 146.

The exterior surface 148 of the arched extension 140 includes rail 150 extending there from.

Figure 11:
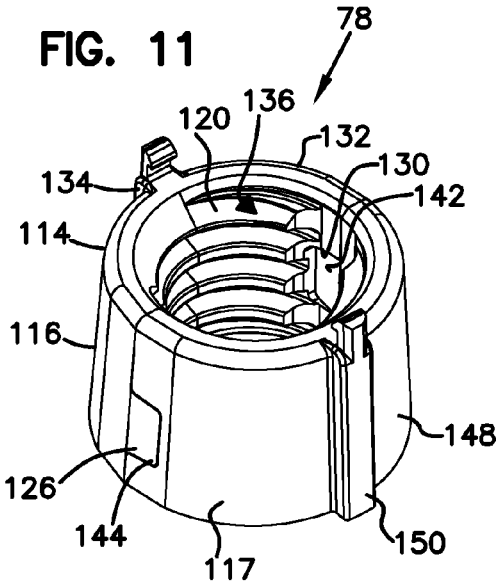
FIG. 11 is a perspective view of a split nut used in the connection of FIG. 8.
Figure 12:
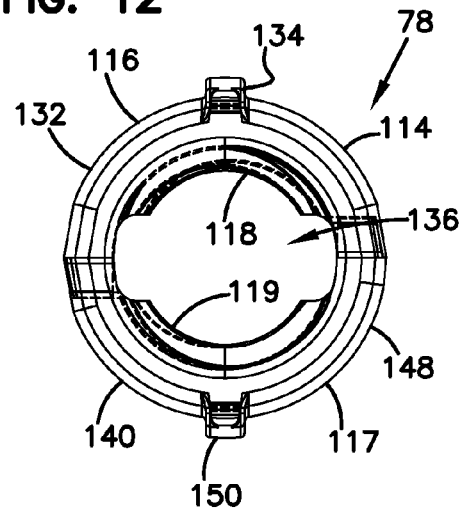
FIG. 12 is a top view of the nut of FIG. 11.

As can be seen in FIGS. 11 and 12, the projection 126 of the first half 116 is received within the recess 144 of the second half 117. The projection 142 of the second half 117 is received by the recess 130 of the first half 116. This results in the nut 78 having the threaded socket 136, made from threads 120, 121 along the respective inner surfaces 118, 119.

Figure 3A:
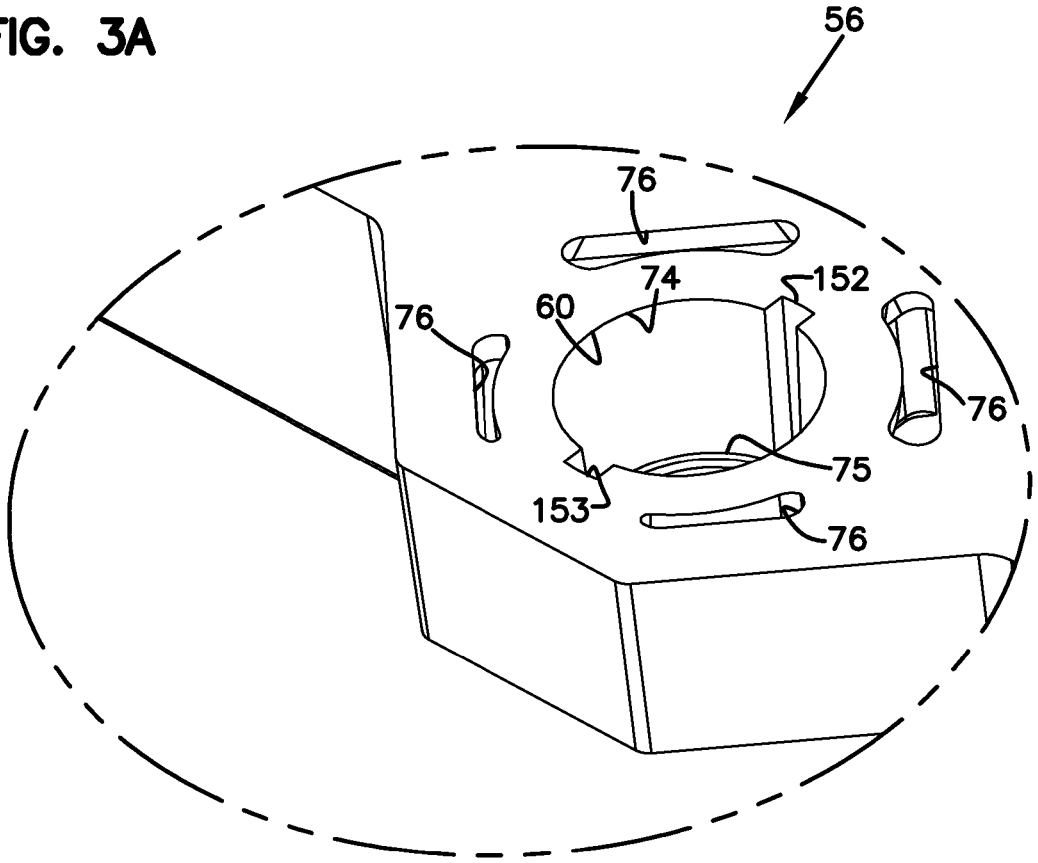
FIG. 3A is an enlarged perspective view of a portion of the mat of FIG. 3, the portion being depicted at 3A in FIG. 3.

The nut 78 fits within the apertures 60 of the first tabs 56. As mentioned above, the aperture 60 in the first tab 56 includes opposite guide slots 152, 153 (FIG. 3A). The guide slots 152, 153 receive the rails 134, 150 of the halves 116, 117 of the split nut 114. The slots 152, 153, in combination with the rails 134, 150 hold the split nut 114 in place in the aperture 60 of the first tab 56. Further, as mentioned previously, in other embodiments, the threads can be molded as part of the aperture 60, in which case, no separate nut 78 will need to be positioned in the aperture 60, but in such cases the aperture 60 is still considered an aperture constructed and arranged to allow releasable fastening thereto, and a "fastener-receiving aperture 60."

In some preferred arrangements, the nut 78 is of a color that will be visually distinct from the color of the porous unit 25. For example, the nut 78 can be yellow, while the porous unit 25 is black. This visually distinct color will help the user installing the mat system 20 to not miss any connections that need to be made between the various porous units 25.

Figure 10:
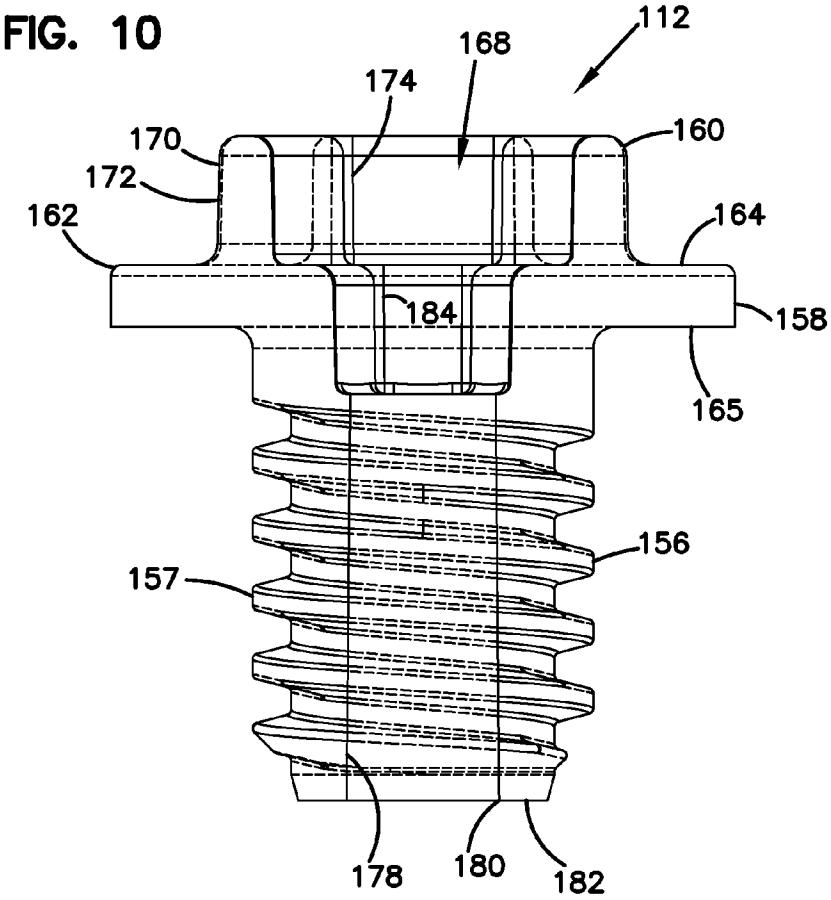
FIG. 10 is a cross-sectional view of the bolt of FIG. 9.
Figure 9:
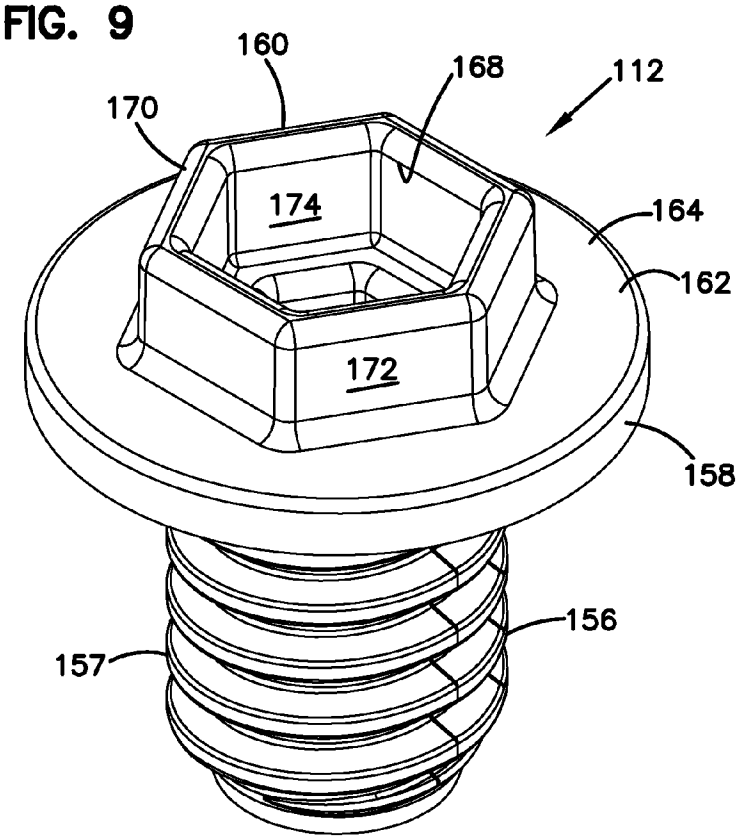
FIG. 9 is a perspective view of a bolt used in the connection of FIG. 8.

The bolt 112 is also part of the fastener arrangement 87. One example usable bolt 112 is illustrated in FIGS. 9 and 10. The bolt 112 can be made from a molded non-metal material. This material can be the same as the material made from the split nut 114, or it may be a different material. The material for the bolt 112 can be the same material as used for the porous units 25, such as a molded thermoplastic, or it may be made from a material stronger than the porous unit 25, such as nylon with glass reinforcement.

In examples shown, the bolt 112 includes a shaft 156, a flange 158, and a head 160. The shaft 156 is threaded with threads 157 that engages with the threaded socket 136 formed by the nut 78.

The flange 158 has a diameter that is wider than the diameter of the shaft 156 and narrower than an outermost dimension of the head 160. The flange 158 acts as a washer 162. The washer 162 has an upper axial surface 164 and a lower axial surface 165 on an opposite side as the upper axial surface 164. As can be seen in FIG. 8, the lower axial surface 165 engages against a flange-receiving surface 166 of the second tab 58 surrounding the second tab aperture 62.

In the embodiments shown, the bolt 112 includes a socket 168. The socket 168 is defined by a head wall 170, having an outer polygon surface 172 and an inner polygon surface 174. The inner polygon surface 174 lines the socket 168. The socket 168 is adapted to receive a torqueing tool 176 (FIGS. 15-20). The tool 176 is discussed further below.

The head wall 170 can have many different shapes. In the illustrated embodiment, the outer polygon surface 172 is a hexagon shape. In the example shown, the inner polygon surface 174 is a hexagon shape.

Still in reference to FIG. 10, the bolt 112 can also include a through hole 178. The through hole 178 extends completely through the bolt 112 from the head 160, through the flange 158 and through the shaft 156, such that the bolt 112 has an opening 180 (FIGS. 8 and 10) at an end 182 of the bolt 112. In preferred embodiments, at least a portion of the through hole 178 has an inner polygon surface 184 lining the through hole 178. The inner polygon surface 184 is shaped and adapted to receive a torqueing tool.

The bolts 112 can be of a different color from the color of the porous units 25. Preferably, the bolts 112 will be of a color contrasting to the color of the porous units 25. For example, the bolts 112 can be yellow, while the porous units 25 are black. This helps the user identify all of the connection points more easily.

Figure 22:
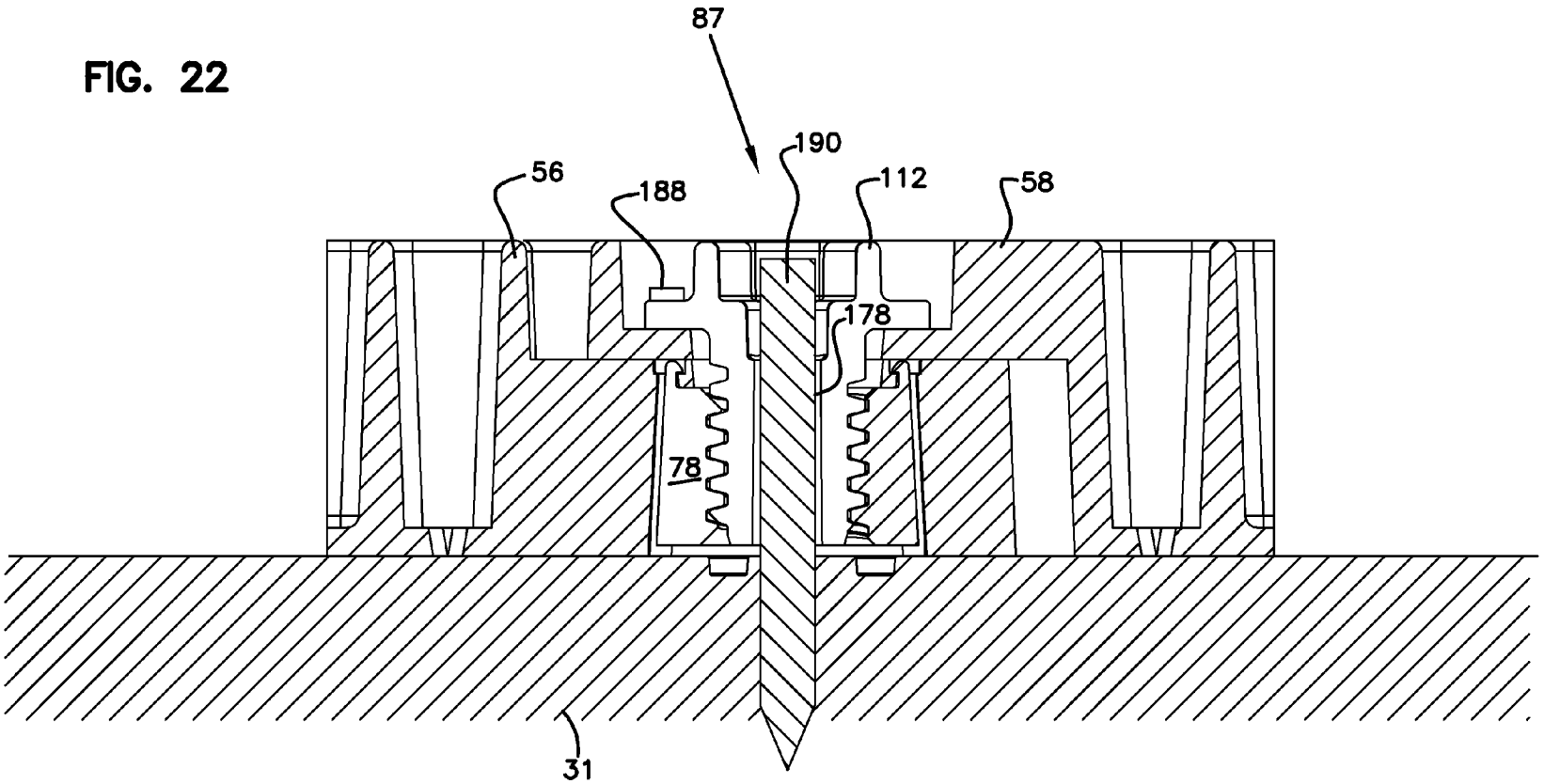
FIG. 22 is a cross-sectional view showing a connection between two of the mats, similar to the cross-section of FIG. 8, and showing a ground stake therein.
Figure 23:
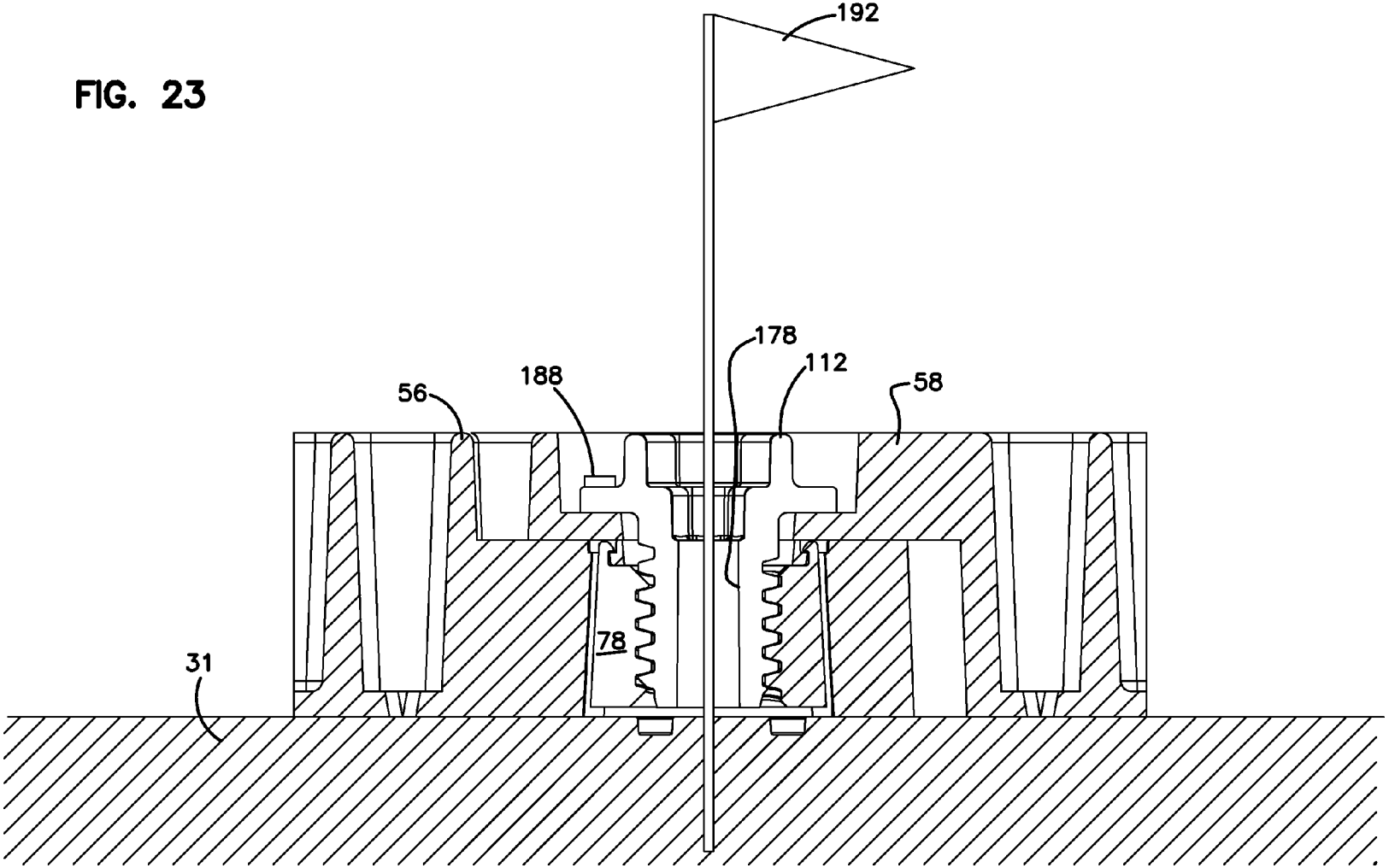
FIG. 23 is a cross-sectional view showing a connection between two of the mats, similar to the cross-section of FIG. 8, and showing a ground delineator therein.

In some embodiments, at least some of the bolts 112 can include a location device 188 (FIGS. 22 and 23), such as an RFID tag or a GPS tag secured thereto. This can provide location information electronically of the connection holding the bolt 112.

In some embodiments, there can be a ground stake 190 (FIG. 22) disposed through the through hole 178 of one of the bolts 112. The ground stake 190 can help anchor the porous unit 25 to the ground.

In some arrangements, there may also be above ground delineators 192 (FIG. 23) disposed through the through hole 178 of one of the bolts 112. These can be used, for example, to identify the outside borders of the overall mat system 20.

The bolts 112 may also have fluorescence or reflectivity additives in the molded material, when making, to result in increasing the visibility of the bolts 112. For example, bolts 112 that are put along an edge of grid 22 to mark the edge of a road, or the edge of a perimeter, can be bolts 112 that have the fluorescence or reflectivity additives. The delineators 192 can also include lights, such solar powered lights, for delineation purposes.

Figure 15:
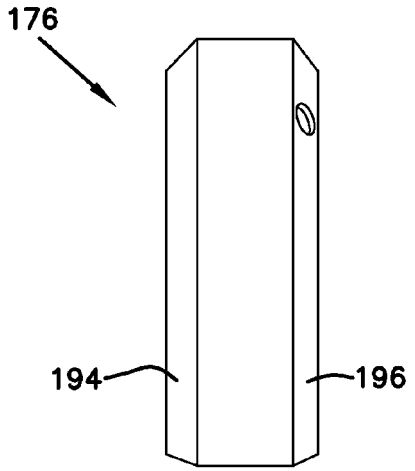
FIG. 15 is a perspective view of one embodiment of an end of a socket wrench usable with the fasteners for the connection of FIG. 8.

The tool 176 of FIGS. 15-20 can be used for both assembling and disassembling the fastener arrangement 87. FIG. 15 illustrates one useable example, embodied as socket wrench 194. The socket wrench 194 includes an outer polygonal wall 196. The polygonal wall 196 is generally the shape of the head wall 170 of the bolt 112. In the example shown, this is a hexagonal shape. An inner surface 197 of the polygonal wall 196 engages the outer polygon surface 172 of the bolt head 160.

Figure 16:
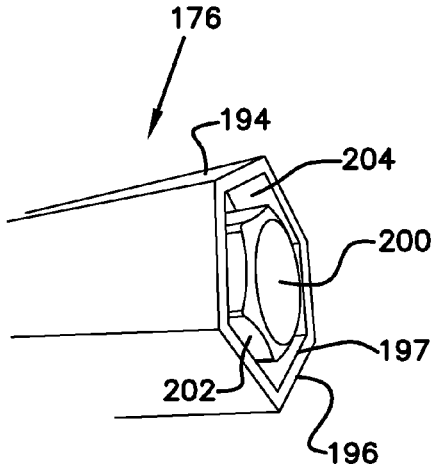
FIG. 16 is a perspective view of an end of the socket wrench shown in FIG. 15.
Figure 17:
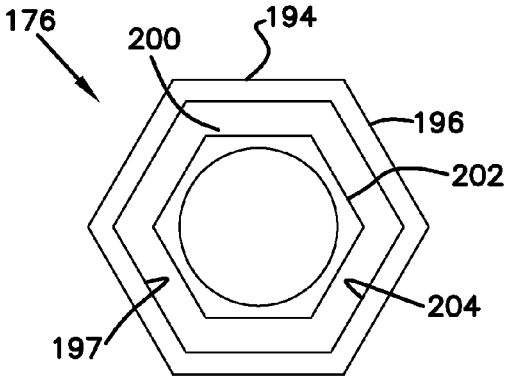
FIG. 17 is an end view of the socket wrench of FIG. 16.
Figure 18:
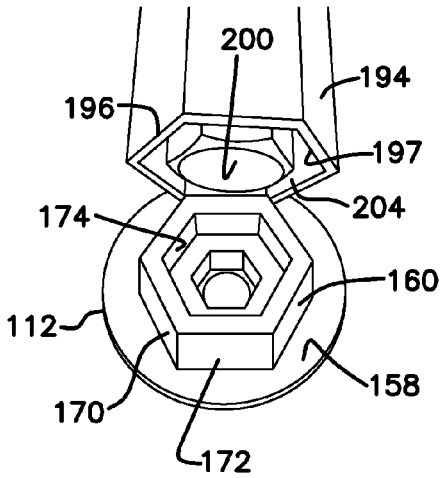
FIG. 18 is a perspective view showing the socket wrench of FIGS. 15-17 being used with the bolt of FIG. 9.

In references to FIGS. 16-18, in this example embodiment, the wrench 194 further includes an Allen wrench 200 mounted inside of the polygonal wall 196. The Allen wrench 200 includes an outer wall 202. The outer polygonal wall 202 is shaped to have the same geometry as the inner polygonal surface 174 of the bolt head 160.

As can be seen in FIGS. 16-18, the outer polygonal wall 202 is spaced from the inner surface of the polygonal wall 196 to define a socket 204 therebetween.

Figure 19:
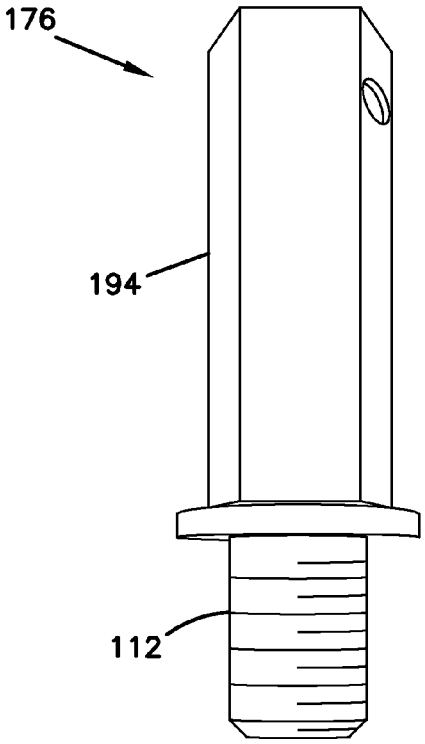
FIG. 19 is a side view of the socket wrench of FIGS. 15-17 inserted onto the bolt of FIG. 9.

FIG. 18 shows the wrench 194 just as it is beginning engagement with the bolt 112. In FIG. 19, a side view of wrench 194 fully engaged with the bolt 112 is depicted. In use, the head wall 170 of the head 160 will be received by the socket 204 of the wrench 194. The inner surface 197 of the polygonal wall 196 will engage against the outer polygonal surface 172 of the head wall 170. The outer polygonal wall 202 of the Allen wrench 200 will engage against the inner polygonal surface 174 of the head wall 170. The tool 176 can then be turned to apply torque between the bolt 112 and the nut 78.

Figure 20:
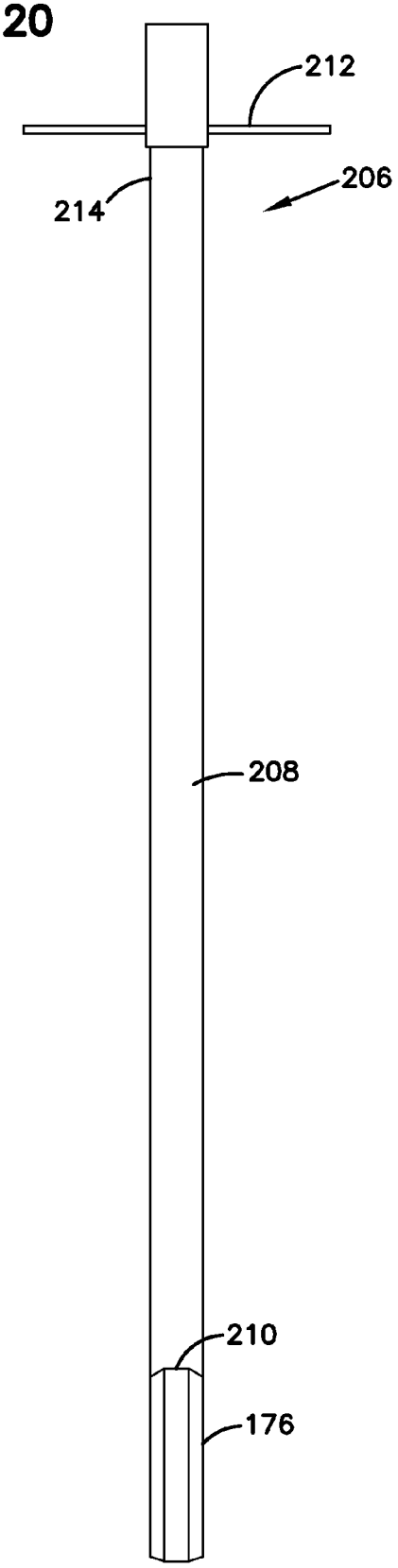
FIG. 20 is a side view of a bolt driver tool with handle used for operating the socket wrench of FIGS. 15-17.

In FIG. 20, a driver tool 206 is illustrated. The driver tool 206 includes the tool 176 and a handle extension 208 extending from a non-bolt engaging end 210. The handle extension 208 can include a cross-bar 212 at or adjacent an end 214 of the handle extension 208 opposite from the end holding the tool 176. The cross-bar 212 can include either a full "T" cross-bar 212 (as shown), to accommodate two hands of a worker, or it may include only half a "T" for only a single hand.

The driver tool 206 can be used by the worker to tighten the bolts 112 within the nuts 78, and without having to crouch, bend over, or work on one's knees. That is, the worker can tighten the bolts 112 in the nuts 78 in a standing position by using the driver tool 206. As such, it should be understood that the handle extension 208 will have a height sufficient to accommodate a standing position of an adult human. The handle extension 208 could also be adjustable in length.

Figure 32:
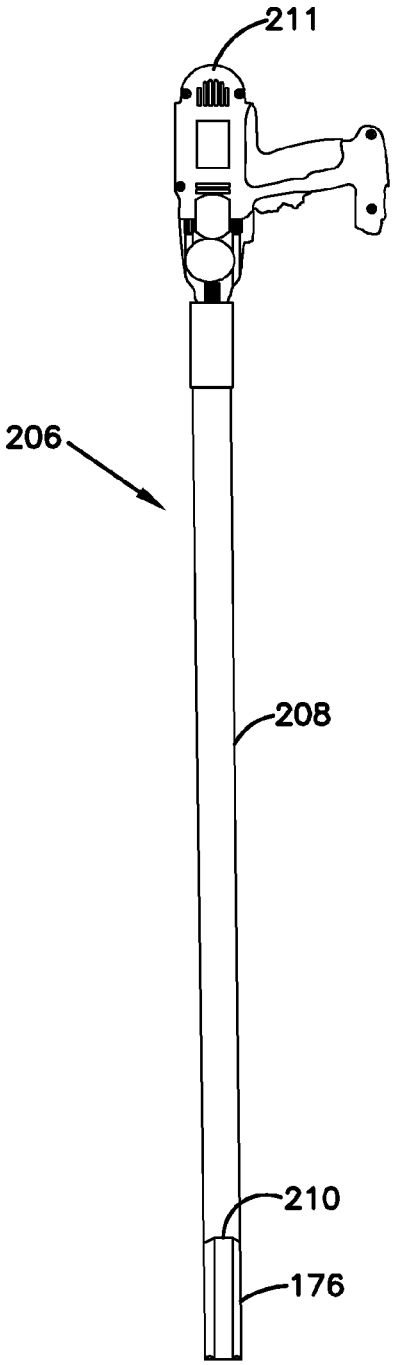
FIG. 32 is a schematic side view of a variation on the bolt driver tool of FIG. 20, this one being shown with an impact wrench.

FIG. 32 shows another variation on the driver tool 206. In this embodiment, there is an impact wrench 211 connected to handle extension 208. The impact wrench 211 could be battery powered, pneumatic powered, or electrically powered. The impact wrench 211 will secure the bolts 112 by driving the tool 176. In some embodiments, the bolts 112 will be partially secured with the impact wrench driver tool 206, and then a final tightening can be by hand, with the tool 206 shown in FIG. 20.

Figure 21:
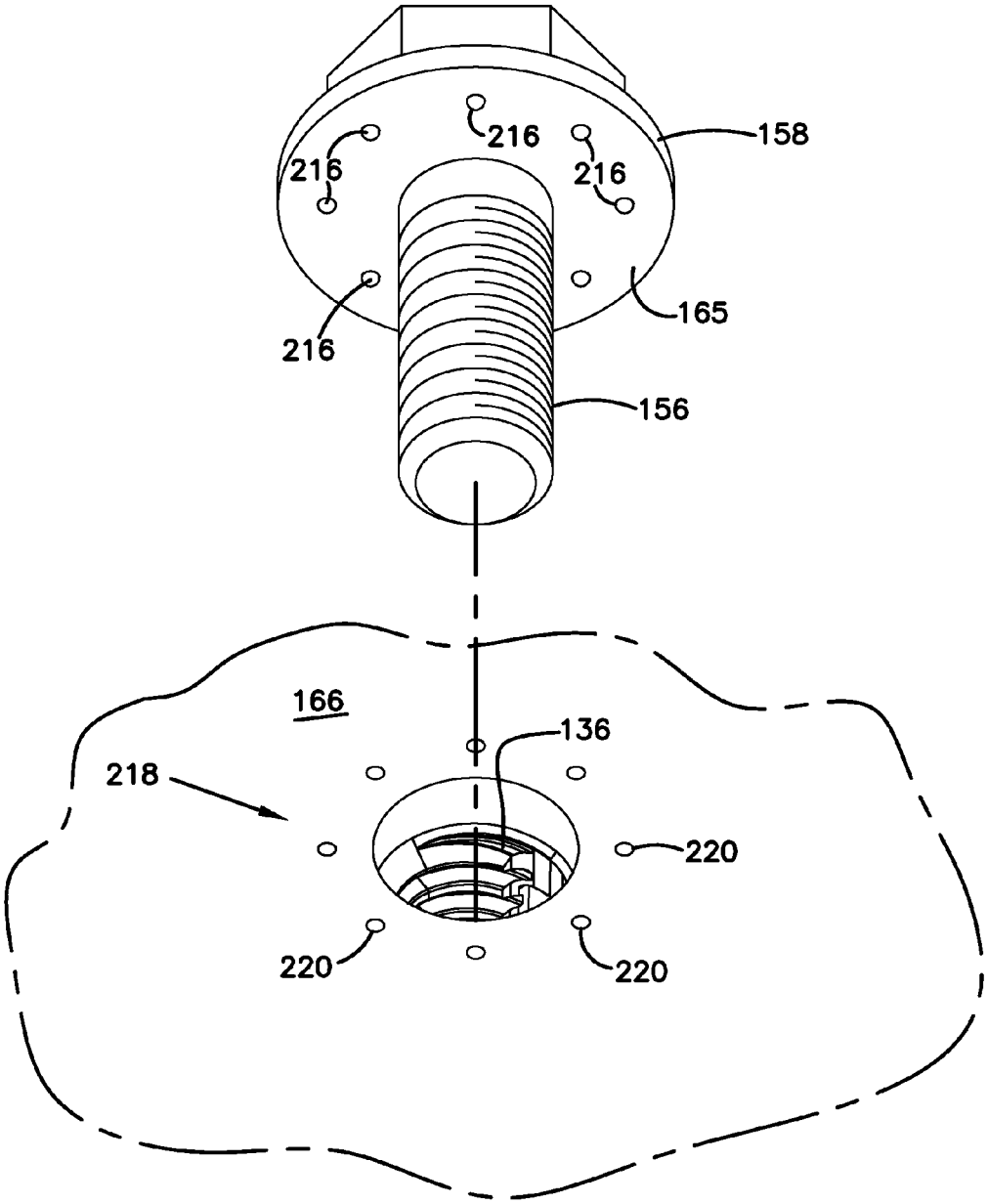
FIG. 21 is a perspective view of an alternate embodiment of bolt and socket arrangement usable in the connection of FIG. 8, the bolt and socket arrangement having a tactile inducing surface.

In some embodiments, the bolt 112 can include a tactile feature to sense a "near home" position of the bolt 112 when torqued into position. One example is shown in FIG. 21. In this embodiment, the bolt flange 158 has a plurality of projections 216 extending from the lower axial surface 165 in a direction toward the threaded shaft 156. As previously mentioned, the second tabs 158 include the flange-receiving surface 166. In this example, the flange-receiving surface 166 defines a tactile-inducing surface 218 for engaging the projections 216 on the flange 158. In the embodiment shown, the tactile-inducing surface 218 includes a plurality of detents 220, such that when the bolt 112 is rotating and being threaded into the socket 136, the lower axial surface 165 of the flange 158 will be rotating relative to the flange-receiving surface 166, and the projections 216 will engage against the detents 220 to produce a tactile sensation, such as a "clicking" The user tightening the bolt 112 into the nut 78 will feel the engagement between the projections 216 and detents 220.

The user will know after so many "clicks" that the bolt 112 is tightly fastened in the nut 78. This feature will help to ensure the connection points are sufficiently tight.

C. Example Anchoring Systems and Components

Figure 31:
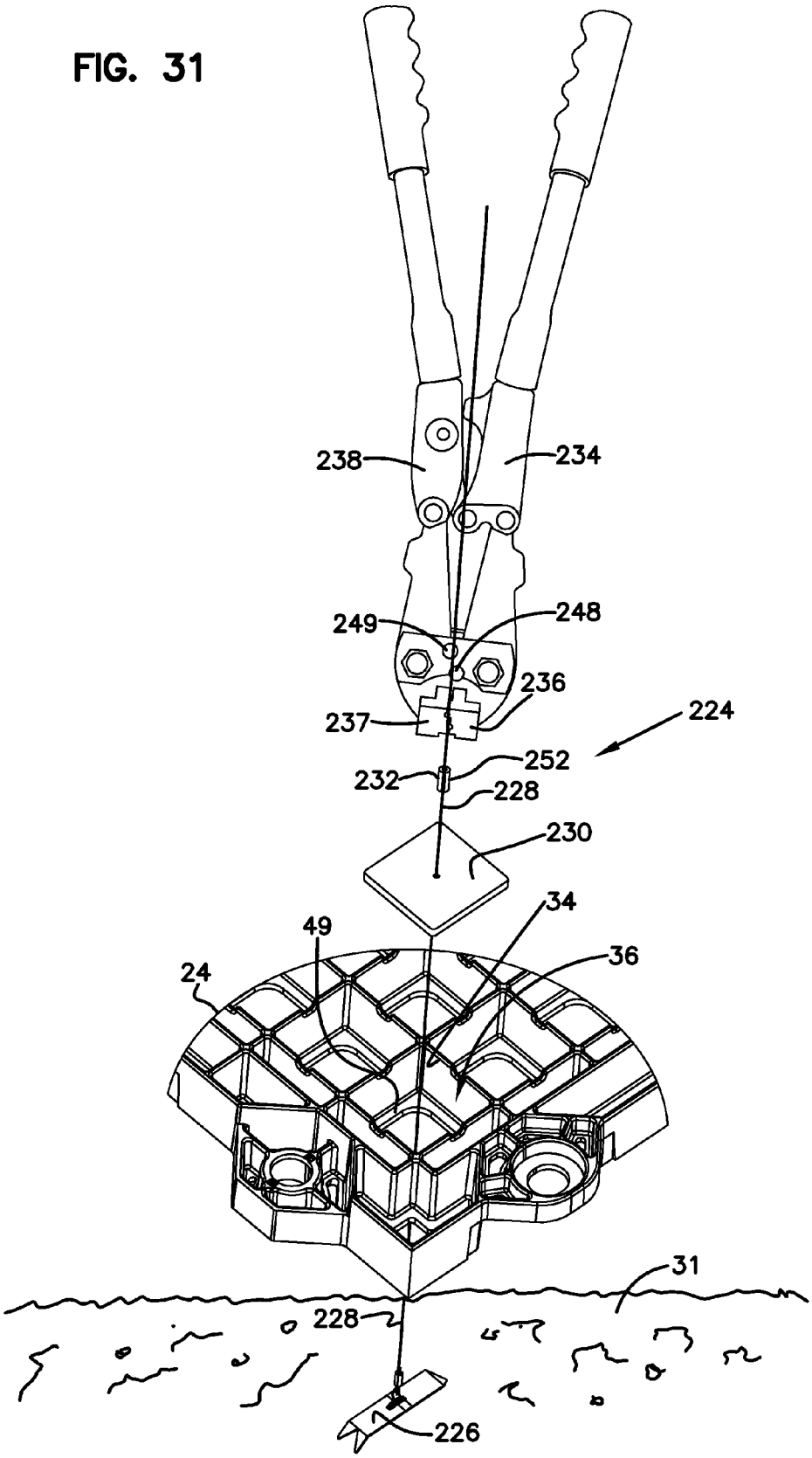
FIG. 31 is a schematic perspective view of a step of placing the ground anchor of FIG. 26 into the ground through a cell of the mat of FIGS. 2-4.

The system 20 can be used with ground anchors 224 (FIGS. 26 and 31) to help secure the system 20 to the terrain or earth 31. In reference now to FIGS. 26 and 31, the ground anchor 224 includes a foot 226, which is embedded into the ground 31 (FIG. 31). A cable 228 is attached to the foot 226 and extends from the foot 226 through one of the cells 36 (FIG. 31) of the mat 24. A washer 230 is mountable against the user side axial surface 49 of the cell 36. A cable stop 232 is secured to the cable 228 and oriented against the washer 230.

Figure 26:
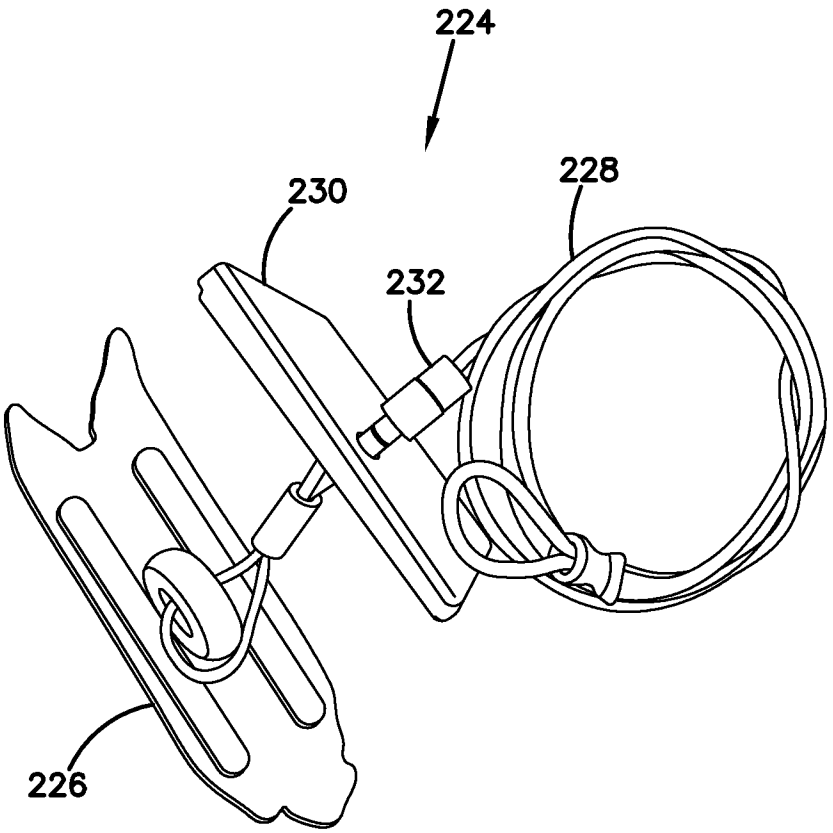
FIG. 26 is a perspective view of an example ground anchor usable to secure the mat system of FIG. 1 to the ground.
Figure 28:
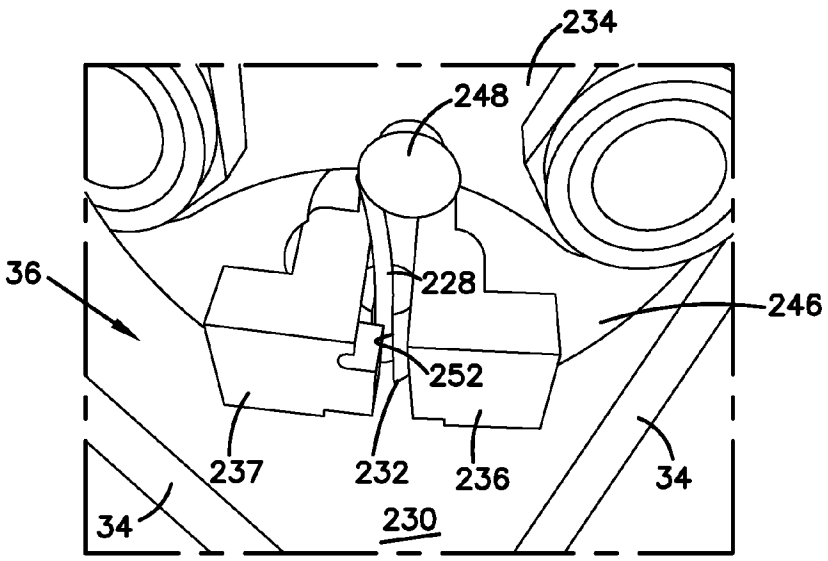
FIG. 28 is another perspective view of a portion of the crimper of FIGS. 24 and 25 securing the ground anchor within a cell of the mat of FIGS. 2-4.

In FIG. 26, the parts of the ground anchor 224 are shown, but not installed in mat 24. In FIG. 31, there is an example shown of the ground anchor 224 being installed within cell 36 of the mat 24. In typical implementations, the mat system 20 can include several ground anchors 224 installed in several respective cells 36 to help secure the mat system 20 to the ground 31.

The washer 230, when operably installed in use, will be inside of cell 36, surrounded by the cell walls 34.

Figure 33:
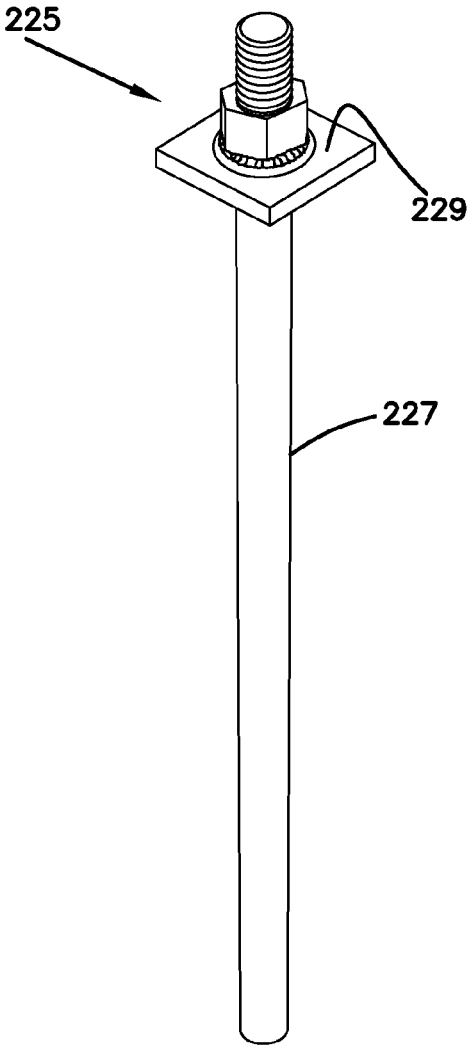
FIG. 33 is a perspective view of another type of ground anchor usable to secure the mat system of FIG. 1 to the ground.

As an alternative to (or along with) the ground anchor 224 of FIGS. 26 and 31, a ground anchor 225 (FIG. 33) can be used. Ground anchor 225 includes a solid rod 227 made from, for example, galvanized metal. A washer 229, depicted here as rectangular or square, is secured to the rod 227 adjacent an end. The washer 229 can be a galvanized metal that is welded to the rod 227. The rod 227 can be used as an anchor when the ground conditions, such as frozen ground, prevent driving foots 226 and cables 228 into the ground. In one example ground anchor 225, the rod 227 is 1 in. diameter×24-40 in. long; the washer 229 is galvanized square metal 2¾ in.×2¾ in., which will fit inside of cell 36.

If there is shifting in the ground 31, or due to a variety of other conditions, it may be that the ground anchor 224 will no longer be tight and positioned to hold the mat 24 in place. In some situations in the prior art, the user would need to apply another, new ground anchor into an adjacent cell. In accordance with principals of this disclosure, however, the user can repair the ground anchor 224 that has become loose.

For example, in this embodiment, to repair the ground anchor 224 that has become loose, the user would pull the cable 228 tight, and move the washer 230 to be against the user side axial surface 49 within the cell 36. The cable stop 232 would then be slid over the cable 228 until it was tight against the washer 230. It should be appreciated that, in this condition, the cable stop 232 is within the walls 34 of the cell 36.

The cable stop 232 will then be slid over the cable 228 until it is tight against the washer 230. It should be appreciated that, in this condition, the cable stop 232 is within the walls 34 of the cell 36.

The cable stop 232 will then need to be tightened or crimped around the cable 228 to hold it tight to the cable 228. Normal crimpers are designed to work perpendicular or 90° to the cable. FIGS. 24, 25, 27, 28 and 31 illustrate a crimper 234 that can be used at an angle of about 10-20°, typically about 15°, relative to the cable 228. In this manner, the crimper 234 can be placed within the walls 34 of the cell 36, and the cable stop 232 can be tightened around the cable 228 within the cell walls 34.

In reference now to FIGS. 24, 25, 27, 28 and 31, the crimper 234 constructed in accordance with principals of this disclosure is illustrated. The crimper 234 includes first and second crimp jaws 236, 237. The jaws 236, 237 are removably mounted within tool 238. As such, the jaws 236, 237 can be removed and replaced in the tool within the field, when needed.

The jaws 236, 237 are mounted at an angle to the tool 238. As mentioned, in typical prior art crimpers, the crimper is designed to work perpendicular to the cable. In this embodiment, the crimp jaws 236, 237 are mounted at an angle 242 of 10-20°, typically about 15°, to the tool 238 (see FIG. 25). When using the tool 238 to access a cable in cell 36, the cable typically will be next to and against the tool, running parallel or close to parallel to the tool 238 (see FIGS. 27 and 28), so the angle 242 is also the approximate angle between the crimp jaws 236, 237 and the cable.

Figure 29:
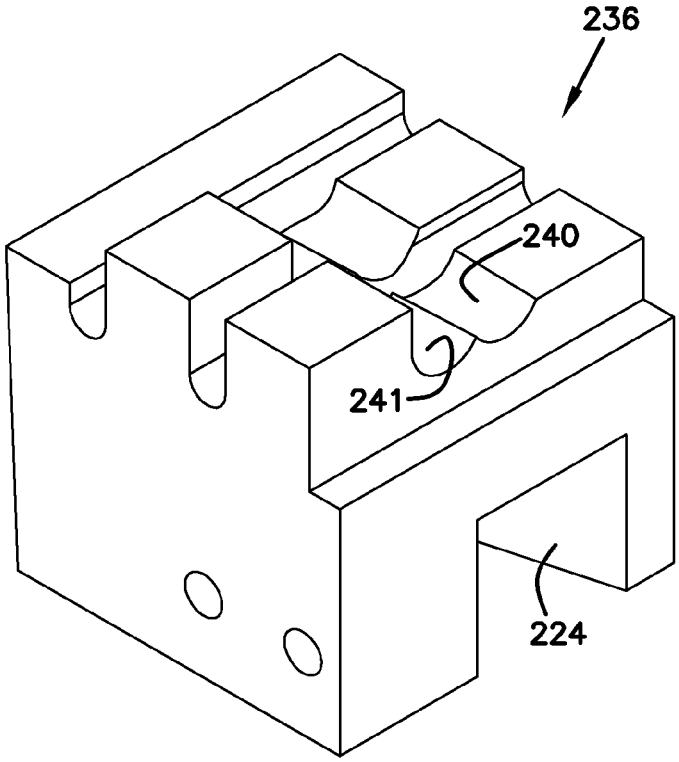
FIG. 29 is a perspective view of one of the crimper jaws used in the crimper of FIGS. 24 and 25.
Figure 30:
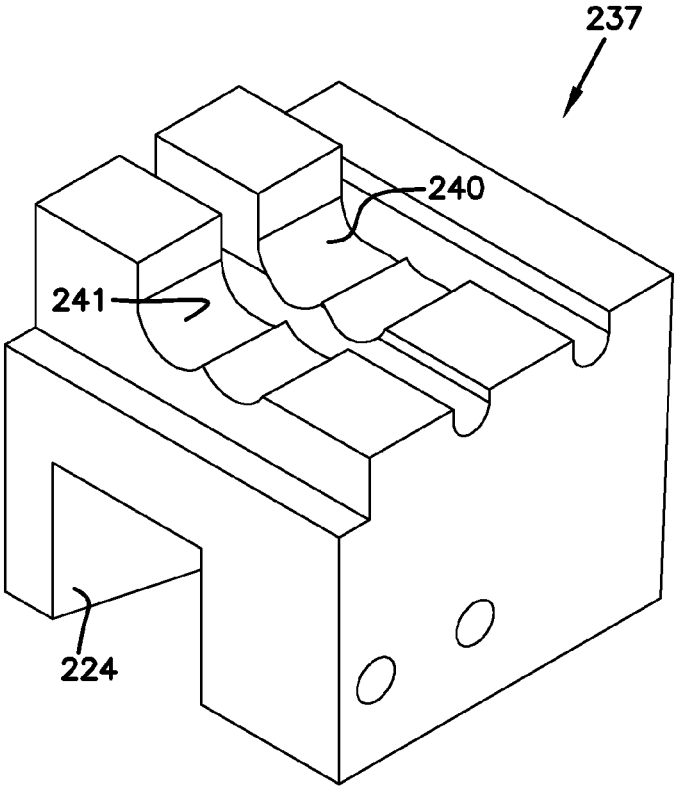
FIG. 30 is a perspective view of another of the crimper jaws used in the crimper of FIGS. 24 and 25.

In FIGS. 29 and 30 perspective views of example crimp jaws 236, 237 are illustrated. Each of the jaws 236, 237 includes a pair of crimp engaging surfaces 240, 241. This allows the crimper 234 to make a double crimp with one stroke of the tool 238. Some example ground anchors 234 will include cable stops 232 that are double in length of a typical one, such that both crimp engaging surfaces 240, 241 will engage and crimp the double length cable stop 232.

The crimp jaws 236, 237 each include a groove 244 for receiving the tool jaws 246 (FIGS. 24, 25 and 28) of the tool 238. Fasteners can then be used to attach the crimping jaws 236, 237 to the tool jaws 246 of the tool 238.

Figure 24:
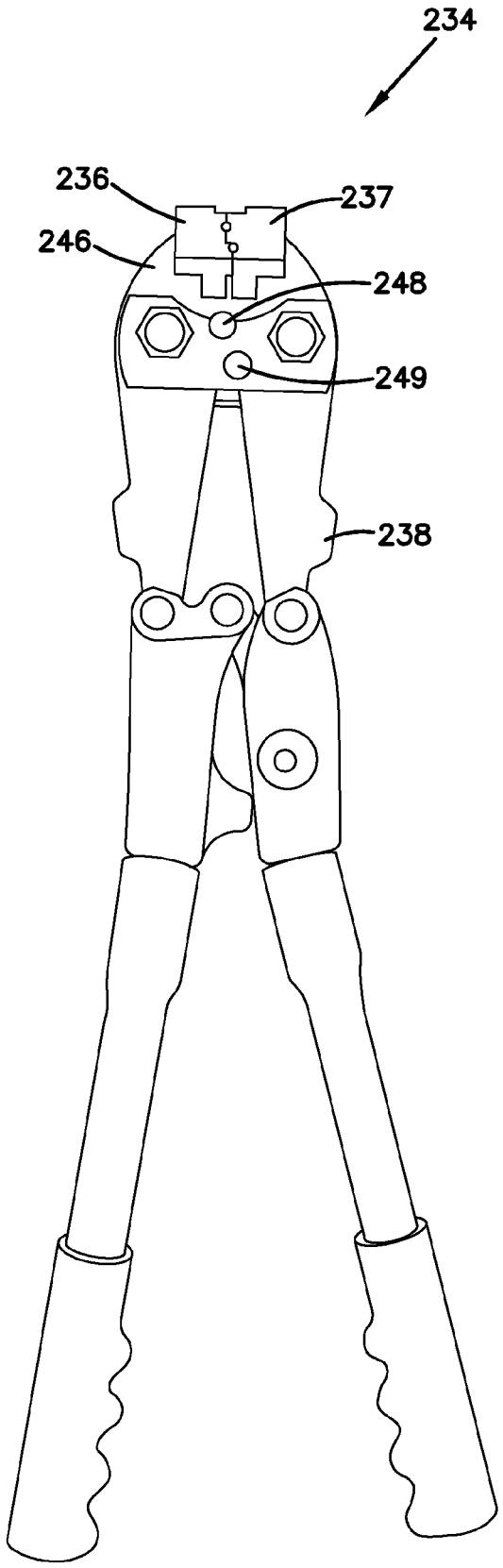
FIG. 24 is top view of one embodiment of a crimper used to secure a ground anchor to the mat system of FIG. 1.
Figure 25:
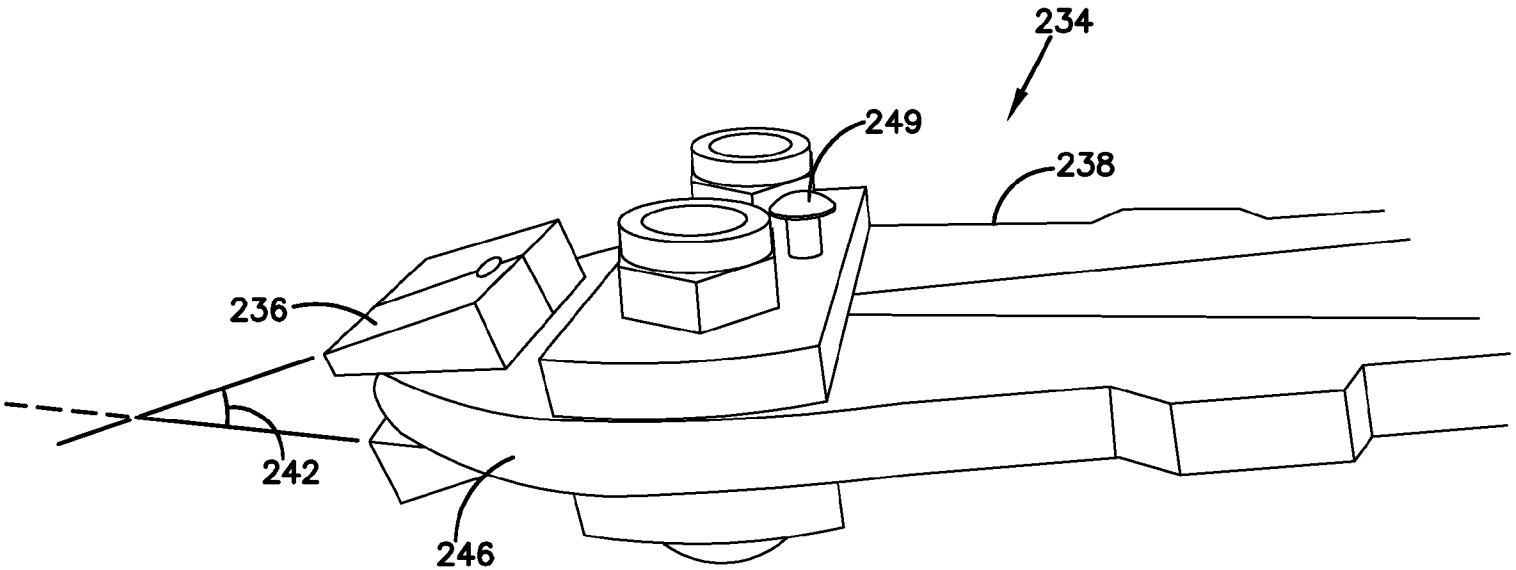
FIG. 25 is a side view of a portion of the crimper of FIG. 24.
Figure 27:
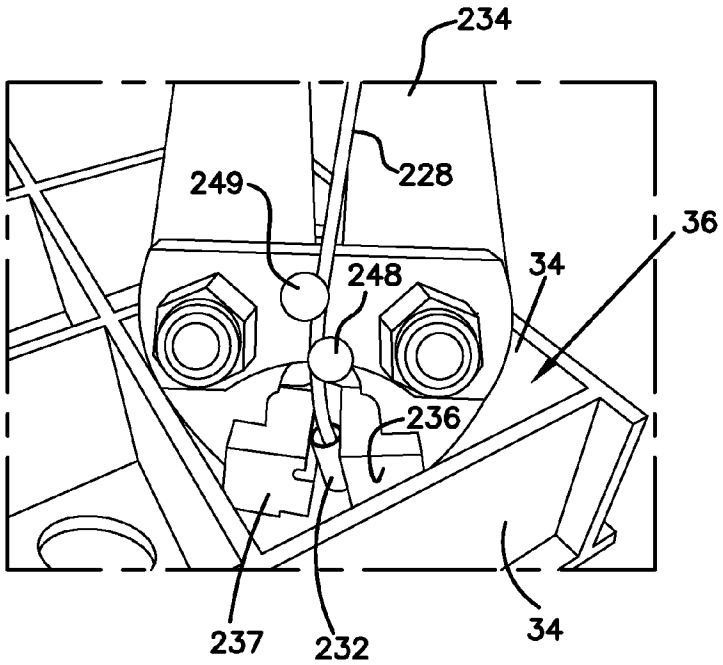
FIG. 27 is a perspective view of a portion of the crimper of FIGS. 24 and 25 securing the ground anchor within a cell of the mat of FIGS. 2-4.

The crimper 234 includes first and second guide screws 248, 249 (FIGS. 24 and 27). The guide screws 248, 249 aid in holding the cable 228 in position during the crimping process. In this manner, both hands can be used to handle the crimper 234, and no extra person or hand is needed to hold the cable 228 tight. The guide screws 248, 249 help to hold the cable 228 tight and in position during the crimping process. As can be seen in FIG. 27, the cable 228 extends from the cable stop 232 and between the two guide screws 248, 249.

The cable stop 232 can include an open side slot 252 (FIG. 28), such that the cable stop 232 can be mounted onto the cable 228 through the slot 252 along the side of the cable stop 232. Prior art cable stops typically do not have open side slots, and are threaded onto cables, like stringing beads.

A kit for constructing mat system 20 can be provided utilizing the materials as described herein. One such kit includes at least first and second porous units 25 and a plurality of fastener arrangements 87.

In one example, the fastener arrangements 87 in the kit include a plurality of split nuts 114 and a plurality of threaded bolts 112.

The kit can include tool 176 to apply a torque force between the bolts 112 and the split nuts 114.

The kits may also include at least one ground anchor 224. The ground anchor will include foot 226, cable 228, washer 230 and cable stop 232.

The kit can also include at least one crimper 234 to apply force to the cable stop 232 and the cable 228 at an angle of about 10-20° relative to the cable 228.

A method of providing a construction mat system 20 can be implemented utilizing the materials and principals as described herein. In the method, a first porous unit, such as first porous unit 82 is provided. A second porous unit, such as second porous 84 is provided and oriented laterally adjacent to and against the first porous unit 82 and so that one of the second porous unit 84 first tabs 56 is oriented under one of the first porous unit 82 second tabs 58 to define first connection 86. One of the second porous unit 84 second tabs 58 is oriented over one of the first porous unit 82 first tabs 56 to define second connection 88. The method includes putting fastener arrangement 87 within the fastener-receiving apertures 60, 62 of the respective first and second tabs 56, 58 of the first connection 86. The method includes putting fastener arrangement 87 within fastener receiving apertures 60, 62 of the respective first and second tabs 56, 58 of the second connection 88.

The step of putting fastener arrangement 87 within the fastener-receiving apertures 60, 62 of the first connection 86 includes putting split nut 114 into the fastener-receiving aperture 60 of the first tab 56 of the first connection 86 and putting threaded bolt 112 into the fastener-receiving aperture 62 of the second tab 58 of the first connection 86. The bolt can include socket 168, outer polygon surface 172 and inner polygon surface 174 lining the socket 168. The method can include using tool 176 to grasp both the outer polygon surface 172 and inner polygon surface 174 to apply a torque force between the bolt 112 and the split nut 114.

The method can include using bolts 112 having a plurality of projections 216 extending from the flange 158, and wherein the second tabs 58 have flange-receiving surface 166 adjacent to the fastener-receiving apertures 62 of the second tabs 58, so that the flange-receiving surface 166 defines tactile inducing surface 218. The step of using tool 176 can include engaging the projections 216 on the flange 158 against the tactile-inducing surface 218 of the flange receiving surface 166.

The method may further include inserting ground anchor 224 through one of the cells 36 of the first and second porous units 82, 84. The ground anchor can include foot 226 embedded into the ground 31; cable 228 attached to the foot 226 and extending from foot 226 through the cell 36; washer 230 against the user side inner axial surface 49 of the walls 34 defining the cell 36; and cable stop 232 secured to the cable 228 and oriented against the washer 230.

The method can further include crimping the cable stop 232 around the cable 228. This may be done by inserting crimper 234 into the cell 36, grasping the cable stop 232 with the crimper 234, and then tightening the cable stop 232 around the cable 228 using the crimper 234.

The step of using the crimper 234 can include holding the crimper 234 at an angle of about 10-20°, typically about 15°, relative to the cable 228.

The above represents principles of this disclosure. Many embodiments can be made using these principles.

What is claimed is:

1. A mat for use in a portable porous construction mat system; the mat comprising:

(a) a porous unit having an outer perimeter and a matrix of intersecting walls defining a plurality of cells within the perimeter;

(b) the porous unit having a bottom mounting side and an opposite user side;

(i) the matrix of intersecting walls defining the plurality of cells opening opposite the bottom mounting side;

(ii) each of the cells in the plurality of cells including a drainage aperture arrangement constructed to permit drainage through the bottom mounting side;

(c) a plurality of first and second tabs projecting from a remainder of the porous unit along the perimeter;

(i) each of the first tabs being recessed from the user side and even with the mounting side;

(ii) each of the second tabs being recessed from the mounting side and even with the user side;

(iii) each of the first and second tabs including an aperture therein constructed and arranged to allow releasable fastening thereto; and wherein the porous unit includes a double wall structure framing the unit and extending between the outer perimeter and the matrix, the double wall structure including an aperture arrangement.

2. A mat according to claim 1 wherein:

(a) each of the apertures of the second tabs is an elongated non-circular opening.

3. A mat according to claim 1 wherein:

(a) each of the apertures of the first tabs includes a pair of opposing generally semi-circular surfaces defining a hole constructed to receive a nut.

4. A mat according to claim 1 wherein:

(a) the porous unit comprises a molded non-metal material.

5. A mat according to claim 1 wherein:

(a) the porous unit has a first pair of opposite sides and a second pair of opposite sides;

(b) at least two first tabs and at least two second tabs are along the perimeter of each of the sides of the first pair;

(c) at least one first tab and at least one second tab is along the perimeter of each of the sides of the second pair; and (d) the first and second tabs alternate sequentially along each of the sides of the first pair and along each of the sides of the second pair.

6. A mat according to claim 5 wherein:

(a) the porous unit has a two-fold axis of symmetry about the axis.

7. A mat according to claim 1 wherein:

(a) the double wall structure is between the matrix and the plurality of first tabs and second tabs.

8. A mat according to claim 1 wherein:

(a) the aperture arrangement of the double wall structure is located between two walls of the double wall structure.

9. A mat according to claim 1 wherein:

(a) the double wall structure includes two parallel, spaced walls.

10. A mat according to claim 9 wherein:

(a) the aperture arrangement of the double wall structure is located between the two parallel walls.

11. A portable porous construction mat system comprising:

(a) a first porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the first porous unit along the perimeter; each of the first tabs being recessed from the user side and even with the mounting side; each of the second tabs being recessed from the mounting side and even with the user side; and each of the first and second tabs including an aperture therein constructed and arranged to allow releasable fastening thereto;

(ii) the first porous unit including a double wall structure framing the first porous unit and extending between the outer perimeter and the matrix, the double wall structure including an aperture arrangement;

(b) a second porous unit laterally adjacent to and against the first porous unit; the second porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the second porous unit along the perimeter; each of the second porous unit first tabs being recessed from the user side and even with the mounting side; each of the second porous unit second tabs being recessed from the mounting side and even with the user side; and each of the second porous unit first and second tabs including an aperture therein constructed and arranged to allow releasable fastening thereto;

(ii) one of the second porous unit first tabs being oriented under one of the first porous unit second tab to define a first connection;

(iii) one of the second porous unit second tabs being oriented over one of the first porous unit first tabs to define a second connection;

(iv) the second porous unit including a double wall structure framing the second porous unit and extending between the outer perimeter and the matrix of the second porous unit, the double wall structure of the second porous unit including an aperture arrangement;

(c) the first connection including a fastener arrangement held within the apertures of the respective first and second tabs of the first connection; and (d) the second connection including a fastener arrangement held within the apertures of the respective first and second tabs of the second connection.

12. A construction mat system according to claim 11 wherein:

(a) the fastener arrangements of each of the first and second connections each includes: a split nut and a threaded bolt secured within the nut;

(b) the fastener-receiving apertures of each of the respective first tabs being shaped to receive one of the split nuts; and (c) the fastener-receiving apertures of each of the respective second tabs being elongated and shaped to receive one of the bolts.

13. A construction mat system according to claim 12 wherein:

(a) the first and second porous units each comprises a molded non-metal material; and (b) each of the split nut and bolt comprises a molded non-metal material.

14. A construction mat system according to claim 12 wherein:

(a) each of the bolts includes a socket.

15. A construction mat system according to claim 14 wherein:

(a) each of the bolts includes an outer polygon surface and an inner polygon surface lining the socket adapted to receive a torqueing tool.

16. A construction mat system according to claim 15 wherein:

(a) each of the bolts includes a through hole, smaller in outermost dimension than the socket, the through hole having an inner polygon surface lining at least a portion of the through hole adapted to receive a torqueing tool.

17. A construction mat system according to claim 12 wherein:

(a) each of the bolts includes a flange and a threaded shaft; a plurality of projections extending from the flange in an axial direction toward the threaded shaft; and (b) each of the second tabs has a flange-receiving axial surface adjacent to the apertures of the second tabs, the flange-receiving axial surface defining a tactile-inducing surface engaging the projections on the flange.

18. The construction mat system of claim 11 further comprising at least one ground anchor for placing through a first cell of one of the first and second porous units.

19. A construction mat system according to claim 11 further including:

(a) at least a third porous unit laterally adjacent to and against the first porous unit; the third porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the third porous unit along the perimeter; each of the third porous unit first tabs being recessed from the user side and even with the mounting side; each of the third porous unit second tabs being recessed from the mounting side and even with the user side; and each of the third porous unit first and second tabs including an aperture therein constructed and arranged to allow releasable fastening thereto;

(ii) one of the third porous unit first tabs being oriented under one of the first porous unit second tab to define a third connection attached by a fastener arrangement;

(iii) one of the third porous unit second tabs being oriented over one of the first porous unit first tabs to define a fourth connection attached by a fastener arrangement;

(iv) the third porous unit including a double wall structure framing the third porous unit and extending between the outer perimeter and the matrix of the third porous unit, the double wall structure of the third porous unit including an aperture arrangement; and (b) the first, second, third, and fourth connections are all along a single side of the first porous unit.

20. A construction mat system according to claim 19 wherein:

(a) the second porous unit and the third porous unit are connected to each other at fifth and sixth connections along sides of the second and third porous units that are perpendicular to the single side of the first porous unit;

(i) the fifth connection includes one of the third porous unit first tabs being oriented under one of the second porous unit second tab and attached by a fastener arrangement; and (iii) the sixth connecting includes one of the third porous unit second tabs being oriented over one of the second porous unit first tabs and attached by a fastener arrangement.

21. A construction mat system according to claim 20 wherein:

(a) the first and second tabs of each of the first porous unit, second porous unit, and third porous unit alternate sequentially.

22. A method of providing a construction mat system; the method comprising:

(a) providing a first porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the first porous unit along the perimeter; each of the first tabs being recessed from the user side and even with the mounting side; each of the second tabs being recessed from the mounting side and even with the user side; and each of the first and second tabs including a aperture therein constructed and arranged to allow releasable fastening thereto;

(ii) the first porous unit including a double wall structure framing the first porous unit and extending between the outer perimeter and the matrix, the double wall structure including an aperture arrangement;

(b) providing a second porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the second porous unit along the perimeter; each of the second porous unit first tabs being recessed from the user side and even with the mounting side; each of the second porous unit second tabs being recessed from the mounting side and even with the user side; and each of the second porous unit first and second tabs including an aperture therein constructed and arranged to allow releasable fastening thereto;

(ii) the second porous unit including a double wall structure framing the second porous unit and extending between the outer perimeter and the matrix of the second porous unit, the double wall structure including an aperture arrangement;

(c) orienting the second porous unit laterally adjacent to and against the first porous unit and so that:

(i) one of the second porous unit first tabs is oriented under one of the first porous unit second tab to define a first connection; and (ii) one of the second porous unit second tabs being oriented over one of the first porous unit first tabs to define a second connection;

(d) putting a fastener arrangement within the apertures of the respective first and second tabs of the first connection; and (e) putting a fastener arrangement within the apertures of the respective first and second tabs of the second connection.

23. A kit comprising:

(a) a first porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the first porous unit along the perimeter; each of the first tabs being recessed from the user side and even with the mounting side; each of the second tabs being recessed from the mounting side and even with the user side; and each of the first and second tabs including an aperture therein constructed and arranged to allow releasable fastening thereto;

(ii) the first porous unit including a double wall structure framing the first porous unit and extending between the outer perimeter and the matrix, the double wall structure including an aperture arrangement;

(b) a second porous unit having an outer perimeter and a matrix of intersecting walls defining a plurality of cells within the perimeter and having a bottom mounting side and an opposite user side; the matrix of intersecting walls defining the plurality of cells opening opposite the bottom mounting side; each of the cells in the plurality of cells including a drainage aperture arrangement constructed to permit drainage through the bottom mounting side;

(i) a plurality of first and second tabs projecting from a remainder of the second porous unit along the perimeter; each of the second porous unit first tabs being recessed from the user side and even with the mounting side; each of the second porous unit second tabs being recessed from the mounting side and even with the user side; and each of the second porous unit first and second tabs including an aperture therein constructed and arranged to allow releasable fastening thereto;

(ii) the second porous unit being constructed and arranged to be positioned laterally adjacent to and against the first porous unit and so that:

(A) one of the second porous unit first tabs can be oriented under one of the first porous unit second tab to define a first connection; and (B) one of the second porous unit second tabs can be oriented over one of the first porous unit first tabs to define a second connection;

(iii) the second porous unit including a double wall structure framing the second porous unit and extending between the outer perimeter and the matrix of the second porous unit, the double wall structure including an aperture arrangement; and (c) a plurality of fastener arrangements sized and shaped to fit within the apertures of the respective first and second tabs of the first connection and within the apertures of the respective first and second tabs of the second connection.

24. The kit of claim 23 further comprising at least one ground anchor for placing through a first cell of one of the first and second porous units.

25. The kit of claim 24 wherein the at least one ground anchor includes a rod having an end for ground insertion and an opposite end having a washer thereon, the washer to be oriented against an inner axial surface of the walls defining the first cell.

26. The method of claim 22 further comprising inserting a ground anchor through a first cell of one of the first and second porous units.

27. The method of claim 26 wherein the step of inserting a ground anchor includes inserting an end of a rod into the ground and pressing a washer secured to the ground anchor against an inner axial surface of walls defining the first cell.

28. The construction mat system of claim 18 wherein the at least one ground anchor includes a rod having an end for ground insertion and an opposite end having a washer thereon, the washer to be oriented against an inner axial surface of the walls defining the first cell.

29. A portable construction mat system comprising:

(a) a mat comprising a porous unit having an outer perimeter and a matrix of intersecting walls defining a plurality of cells within the perimeter; the cells having a through hole therethrough;

(i) the porous unit having a bottom mounting side facing ground, and a user side opposite the mounting side; the matrix of intersecting walls defining the plurality of cells opening opposite the bottom mounting side; each of the cells in the plurality of cells including a drainage aperture arrangement constructed to permit drainage through the bottom mounting side;

(ii) a plurality of first and second tabs projecting from the porous unit along the perimeter, each of the first and second tabs including an aperture therein to allow releasable fastening thereto;

(iii) the porous unit including a double wall structure framing the porous unit and extending between the outer perimeter and the matrix, the double wall structure including an aperture arrangement; and (b) a ground anchor constructed and arranged to be oriented through a first one of the cells to secure the mat to the ground.

30. The construction mat system according to claim 29 wherein:

(a) the ground anchor comprises a solid rod, said rod having an insertion end for insertion in the ground and an opposite end having a washer secured thereto;

(i) the washer being configured and adapted to lie atop the mounting side of the first one of the cells when the rod is inserted through the through hole into the ground.

31. The construction mat system of claim 29 wherein the ground anchor includes:

(a) a foot to be embedded into the ground;

(b) a cable attached to the foot and to extend from the foot and through the first one of the cells;

(c) a washer to be oriented against an inner axial surface of the walls defining the first one of the cells; and (d) a cable stop to be secured to the cable and oriented against the washer.

32. The construction mat system of claim 29 wherein:

(a) each of the first tabs is recessed from the user side and even with the mounting side; and (b) each of the second tabs is recessed from the mounting side and even with the user side.

* * * * *